US008752741B2

(12) United States Patent
Stevens

(10) Patent No.: US 8,752,741 B2
(45) **Date of Patent: *Jun. 17, 2014**

(54) HOLSTER ASSEMBLY AND METHOD USING SAME

(75) Inventor: Victor Stevens, Sahuarita, AZ (US)

(73) Assignee: Slide TEK LLC, Poulsbo, WA (US)

( * ) Notice: Subject to any disclaimer, the term of this patent is extended or adjusted under 35 U.S.C. 154(b) by 2694 days.

This patent is subject to a terminal disclaimer.

(21) Appl. No.: 11/291,631

(22) Filed: Nov. 30, 2005

(65) Prior Publication Data

US 2008/0093400 A1 Apr. 24, 2008

(51) Int. Cl.
*F41C 33/02* (2006.01)

(52) U.S. Cl.
USPC ..... 224/243

(58) Field of Classification Search
USPC ..... 224/243, 244, 911, 912, 192, 193, 196, 224/198, 245, 249, 663, 238; 42/70.07, 42/70.06, 70.11, 87, 88; 206/317; 211/64
See application file for complete search history.

(56) References Cited

U.S. PATENT DOCUMENTS

| | | | | | |
|---|---|---|---|---|---|
| 2,551,913 | A * | 5/1951 | Toby | 224/244 |
| 3,669,325 | A * | 6/1972 | Furman | 224/243 |
| 3,763,587 | A | 10/1973 | Firmalino | |
| 3,804,306 | A | 4/1974 | Azurin | |
| 4,055,015 | A * | 10/1977 | Musgrave | 42/106 |
| 4,138,044 | A | 2/1979 | Musgrave | |
| 4,298,150 | A | 11/1981 | Seldeen | |
| 4,342,410 | A * | 8/1982 | Sloan | 224/243 |
| 5,168,994 | A | 12/1992 | Beletsky | |
| 5,284,281 | A * | 2/1994 | Nichols | 224/244 |
| 6,488,148 | B1 * | 12/2002 | Woodson | 206/317 |
| 6,561,073 | B1 | 5/2003 | Hogmoe | |
| 6,641,009 | B2 * | 11/2003 | French et al. | 224/244 |
| 6,948,644 | B1 * | 9/2005 | Beletsky | 224/193 |

* cited by examiner

*Primary Examiner* — Nathan J Newhouse

(74) *Attorney, Agent, or Firm* — Dale F. Regelman; Quarles & Brady LLP

(57) ABSTRACT

A holster assembly, and method using same, are disclosed. The holster comprises a base and a trigger housing mechanism slidably disposed on that base, wherein the trigger housing mechanism can be slidingly moved bidirectionally between a first position and a second position. The holster assembly further comprises a spring having a first end and a second end, wherein the first end of the spring is attached to the base, and wherein the second end of the spring is attached to the trigger housing mechanism.

10 Claims, 26 Drawing Sheets

HOLSTER ASSEMBLY AND METHOD USING SAME

FIELD OF THE INVENTION

The invention relates to a holster for a handgun, and a method using same.

BACKGROUND OF THE INVENTION

Various holster designs are known in the art. Many police, military, and security personnel, carry firearms for the protection of the public and themselves. Such firearms often comprises handguns referred to as "self-loading" pistols. For safety reasons, those self-loading pistols are carried in a holster, and do not have a round loaded in the firing chamber.

In an emergent situation, such police, military, security personnel may have occasion to draw the pistol from the holster and discharge that weapon. The time required to remove the pistol from the holster and then to manually move a sliding portion of the pistol to dispose a round in the firing chamber is critical.

What is needed is a holster assembly that facilitates loading a round into the firing chamber, and assists the removal of the loaded pistol from the holster. Applicant's holster assembly, and method using same, achieves these objectives.

SUMMARY OF THE INVENTION

Applicant's invention includes a holster, comprising a base; a trigger housing mechanism slidably disposed on the base, wherein said trigger housing mechanism can be slidingly moved bidirectionally between a first position and a second position; a barrel housing assembly fixedly attached to the base, and a spring having a first end and a second end, wherein the first end of the spring is attached to the base, and wherein the second end of the spring is attached to the trigger housing mechanism.

BRIEF DESCRIPTION OF THE DRAWINGS

The invention will be better understood from a reading of the following detailed description taken in conjunction with the drawings in which like reference designators are used to designate like elements, and in which:

FIG. 6C is a side view of a self-loading pistol in an operational configuration;

FIG. 6D is a side view of the pistol of FIG. 6C in a loading configuration;

DETAILED DESCRIPTION OF THE PREFERRED EMBODIMENTS

This invention is described in preferred embodiments in the following description with reference to the Figures, in which like numbers represent the same or similar elements.

Figure 6A:
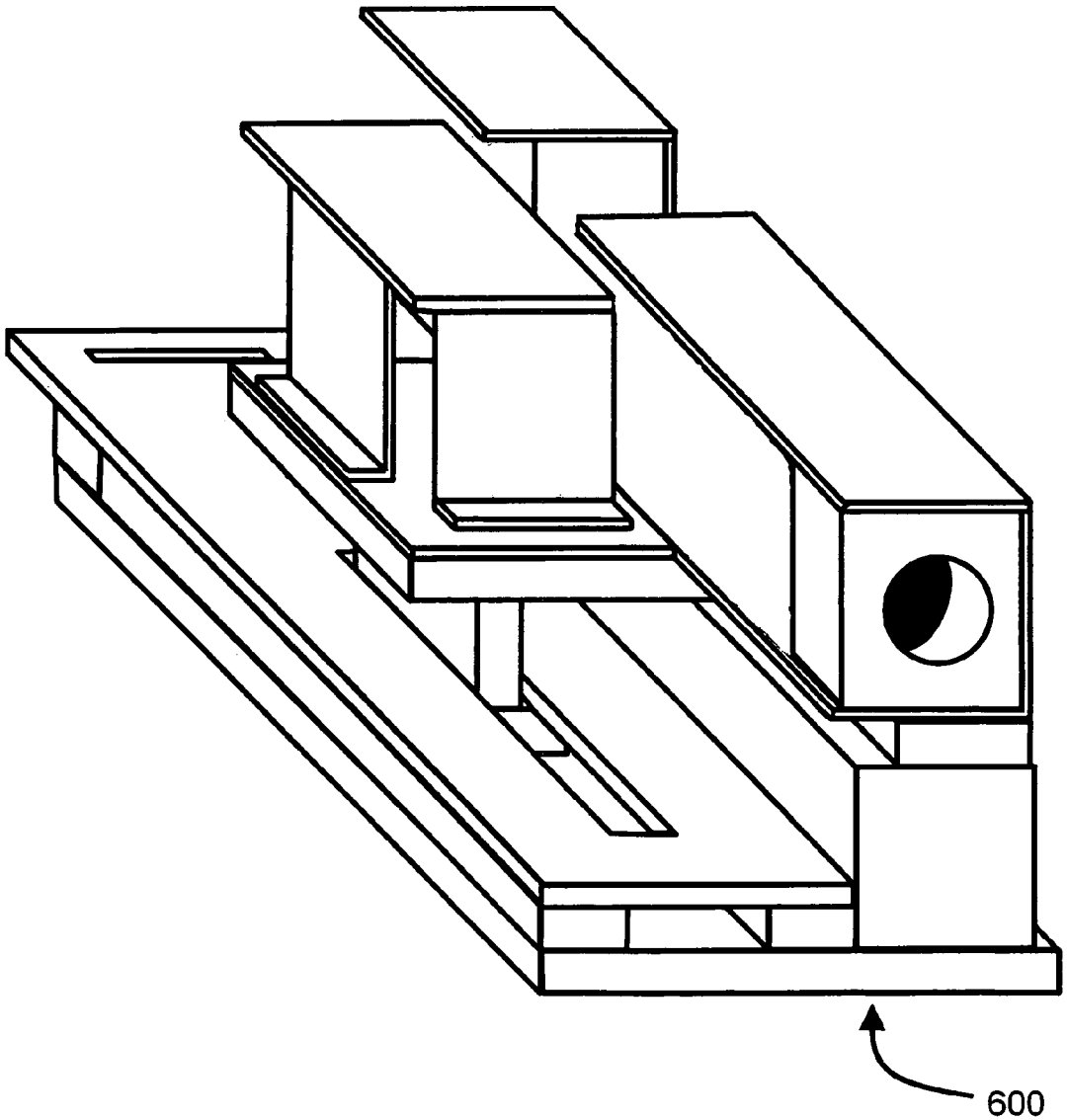
FIG. 6A is a perspective view of Applicant's holster assembly.
Figure 6B:
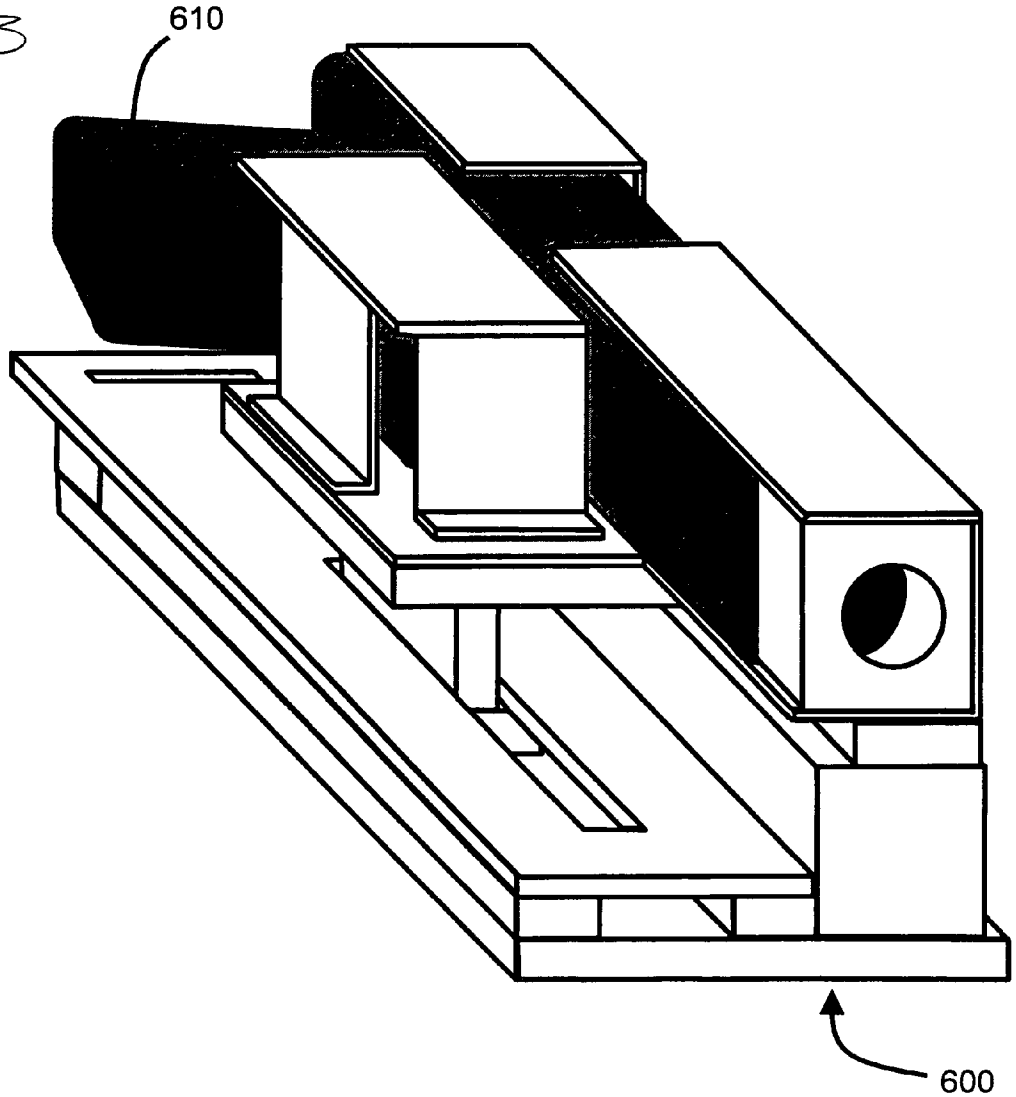
FIG. 6B is a perspective view of a hand gun removeably disposed in Applicant's holster assembly.
Figure 16C:
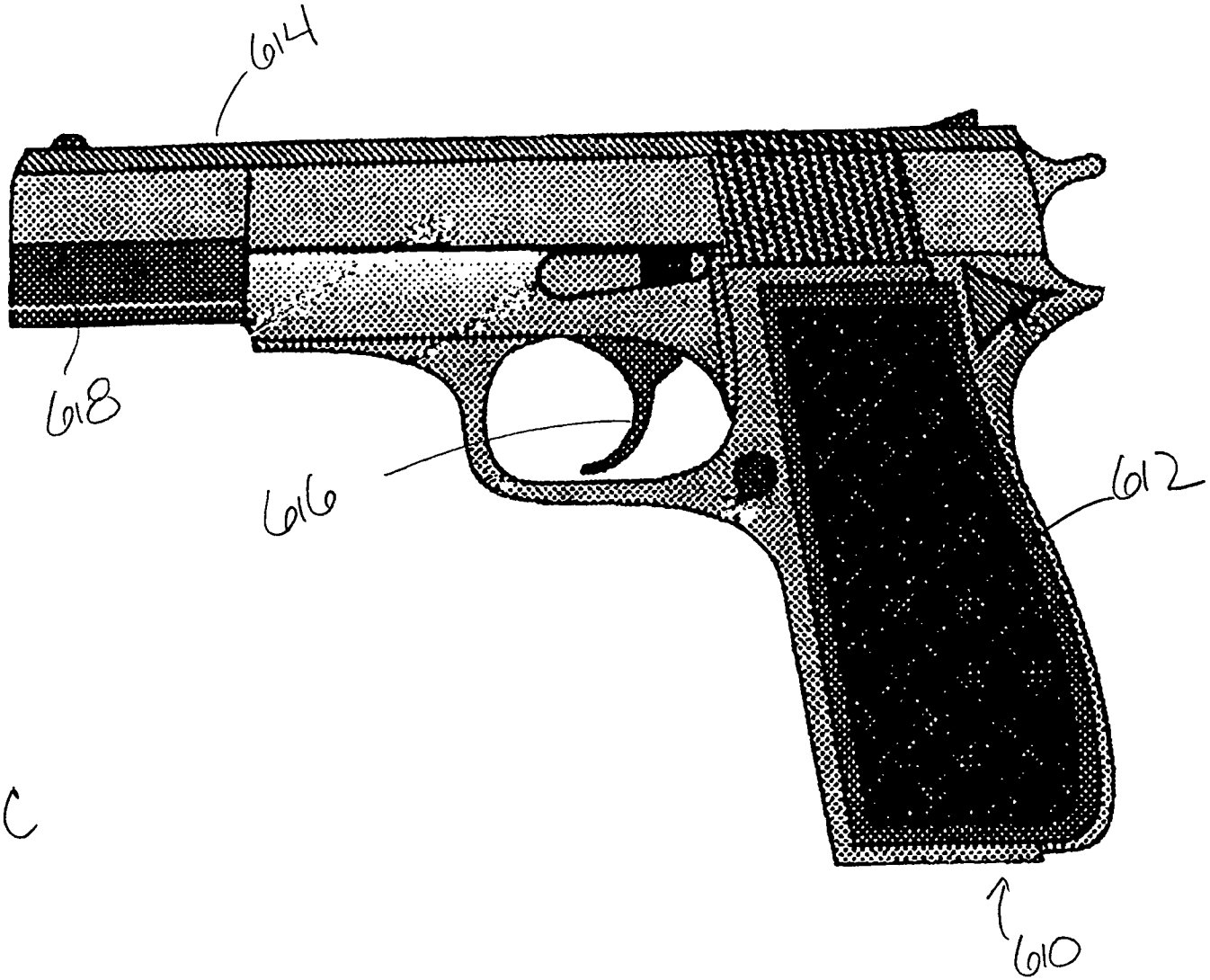
Figure 17:
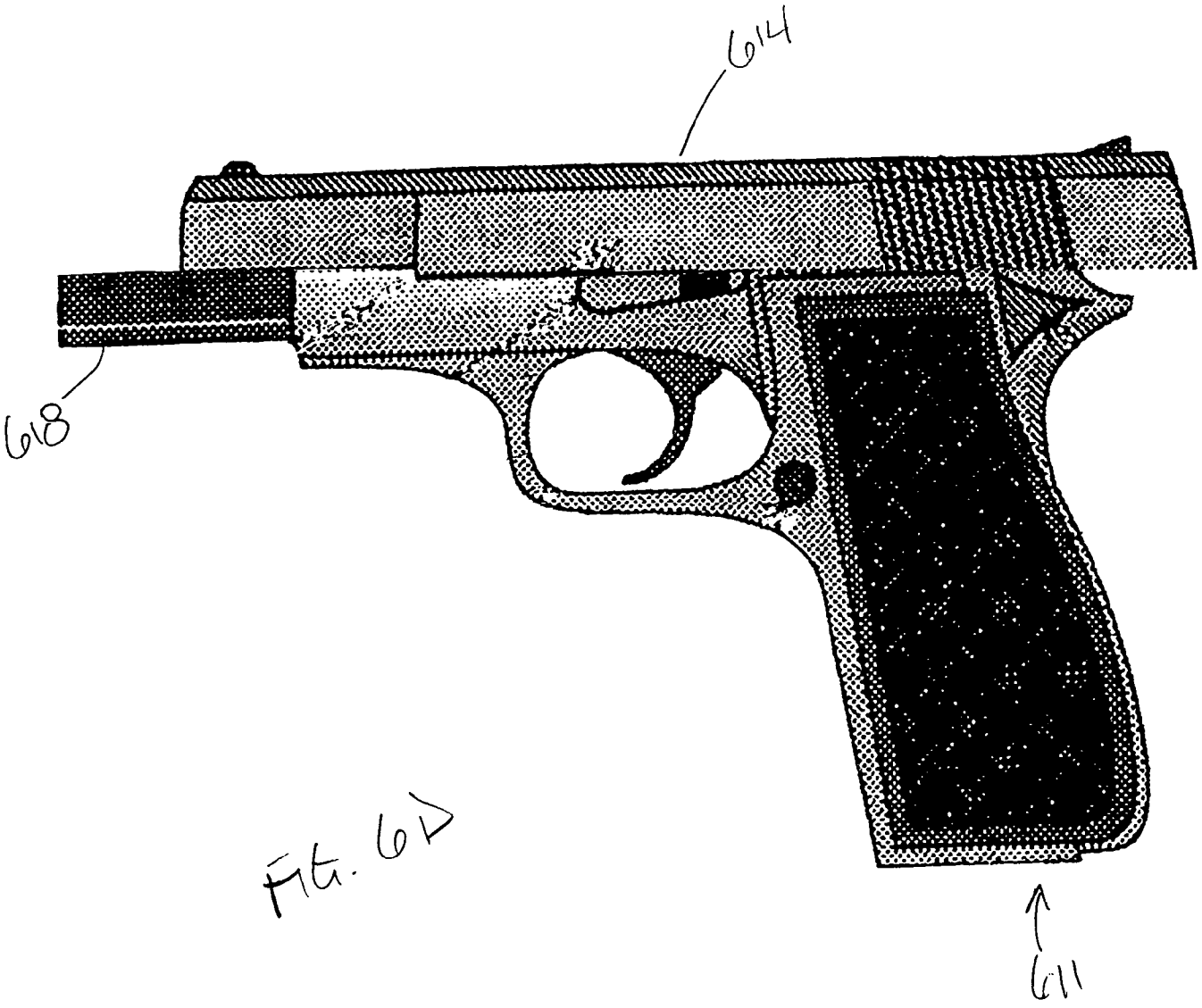

FIG. 6A shows a perspective view of Applicant's holster assembly 600. FIG. 6B shows a perspective view of Applicant's holster assembly 600 with pistol 610 removeably disposed therein.

As described in more detail hereinbelow, Applicant's holster assembly 600 facilitates loading a round into the firing chamber of pistol 610, and assists the removal of the loaded pistol from the holster. In addition, Applicant's holster assembly and method allow the user to load pistol 610 using only one hand. Using prior art holsters, two hands are needed to withdraw and load a pistol from a holster.

Such one-handed operation allows disabled persons, or persons having limited use of one arm, to operate an automatic pistol for self protection, hunting, competition, or target shooting in general. In addition such one-handed operation is a significant benefit for police, military, and/or security personnel. For example, if a police officer is detaining a suspect with one hand and another person charges towards that officer, using a prior art holster the officer would have to release the suspect in order to use both hands to draw and cycle the pistol. Using Applicant's holster assembly and method, however, the officer can continue to detain the suspect with one hand, dispose a round into the firing chamber of the pistol in the holster with the other hand, and draw the pistol on the charging person without releasing the suspect.

Figure 1A:
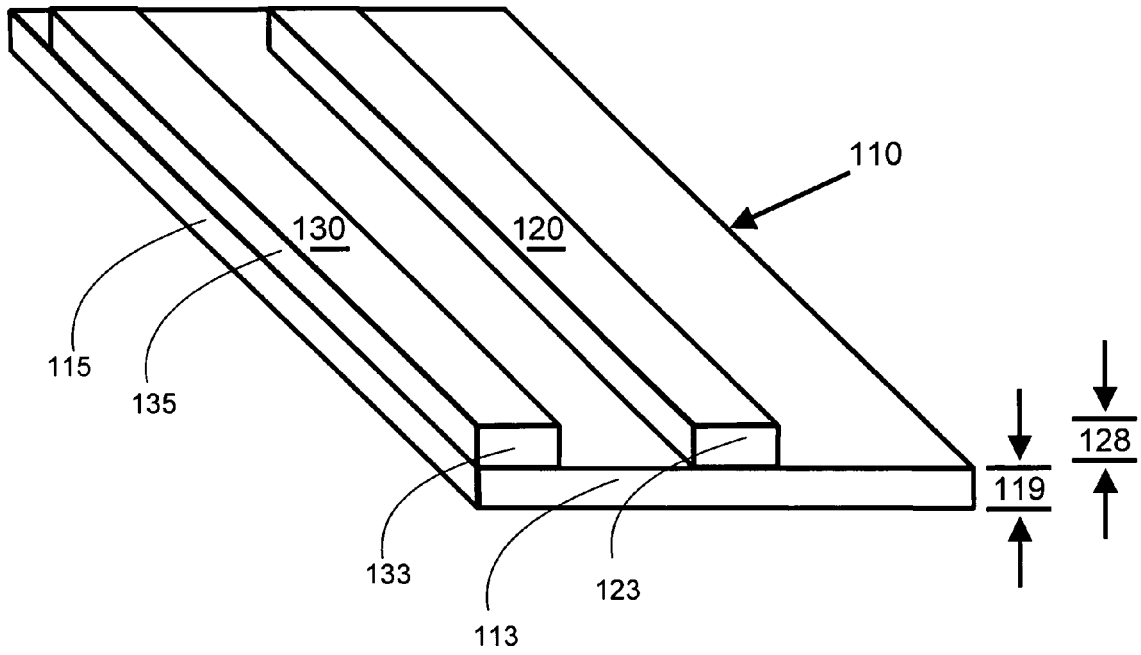
FIG. 1A is a perspective view certain elements of Applicant's holster assembly.
Figure 1B:
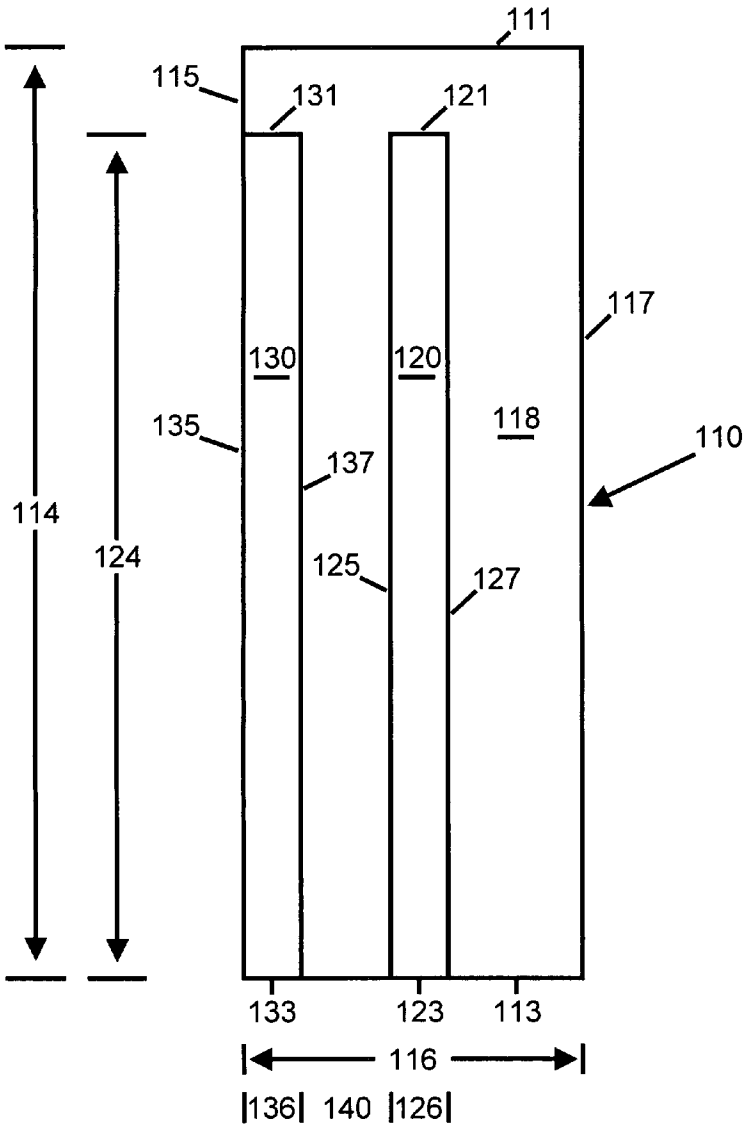
FIG. 1B is a block diagram showing the elements of FIG. 1A.

Referring now to FIGS. 1A and 1B, Applicant's holster assembly 600 comprises base 110. In the illustrated embodiment of FIGS. 1A and 1B, base 110 comprises a planar member having a first end 111, a second end 113, a first side 115, a second side 117, a length 114, a width 116, and a thickness 119. In certain embodiments, base 110 is formed from a rigid material, such as without limitation wood, metal, molded plastic, leather, combinations thereof, and the like.

In certain embodiments, length 114 is between about 3 inches and about 16 inches. In certain embodiments, length 114 is about 8 inches. In certain embodiments, width 116 is between about 2 inches and about 6 inches. In certain embodiments, width 116 is about 3 inches. In certain embodiments, thickness 119 is between about 0.05 inches and about 0.50 inches. In certain embodiments, thickness 119 is about 0.20 inches.

Slide rail 130 is attached to base 110 such that end 133 is flush with end 113 of base 110, and such that side 135 is flush with side 115 of base 110. In certain embodiments, slide rail 130 is formed from a rigid material, such as without limitation wood, metal, molded plastic, leather, combinations thereof, and the like. Slide rail 130 has length 124, width 136, and thickness 128. In certain embodiments, length 124 is between about 2.25 inches and about 15.25 inches. In certain embodiments, length 124 is about 7.25 inches. In certain embodiments, width 136 is between about 0.25 inches and about 1 inch. In certain embodiments, width 136 is about 0.5 inches. In certain embodiments, thickness 128 is between about 0.05 inches and about 0.50 inches. In certain embodiments, thickness 128 is about 0.25 inches.

Slide rail 130 is attached to base 110 using conventional attachment means, such as and without limitation adhesive bonding, welding, plastic welding, mechanical fasteners, i.e. nuts, bolts, and the like. In certain embodiments, slide rail 130 and base 110 comprise an integrally molded assembly.

Slide rail 120 is attached to base 110 such that end 123 is flush with end 113 of base 110, and such that side 125 is a distance 140 from side 137 of slide rail 130. Slide rail 120, slide rail 130, and base 110, in combination, define a three-sided, U-shaped, assembly. In certain embodiments, slide rail 120 is formed from a rigid material, such as without limitation wood, metal, molded plastic, leather, combinations thereof, and the like. Slide rail 120 has length 124, width 126, and thickness 129 In certain embodiments, width 126 is between about 0.25 inches and about 1 inch. In certain embodiments, width 126 is about 0.5 inches. In certain embodiments, thickness 128 is between about 0.05 inches and about 0.50 inches. In certain embodiments, thickness 128 is about 0.25 inches.

Slide rail 120 is attached to base 110 using conventional attachment means, such as and without limitation adhesive bonding, welding, plastic welding, mechanical fasteners, i.e. nuts, bolts, and the like. In certain embodiments, slide rail 120 and base 110 comprise an integrally molded assembly. In certain embodiments, slide rail 120, slide rail 130, and base 110 comprise an integrally molded assembly.

Figure 2A:
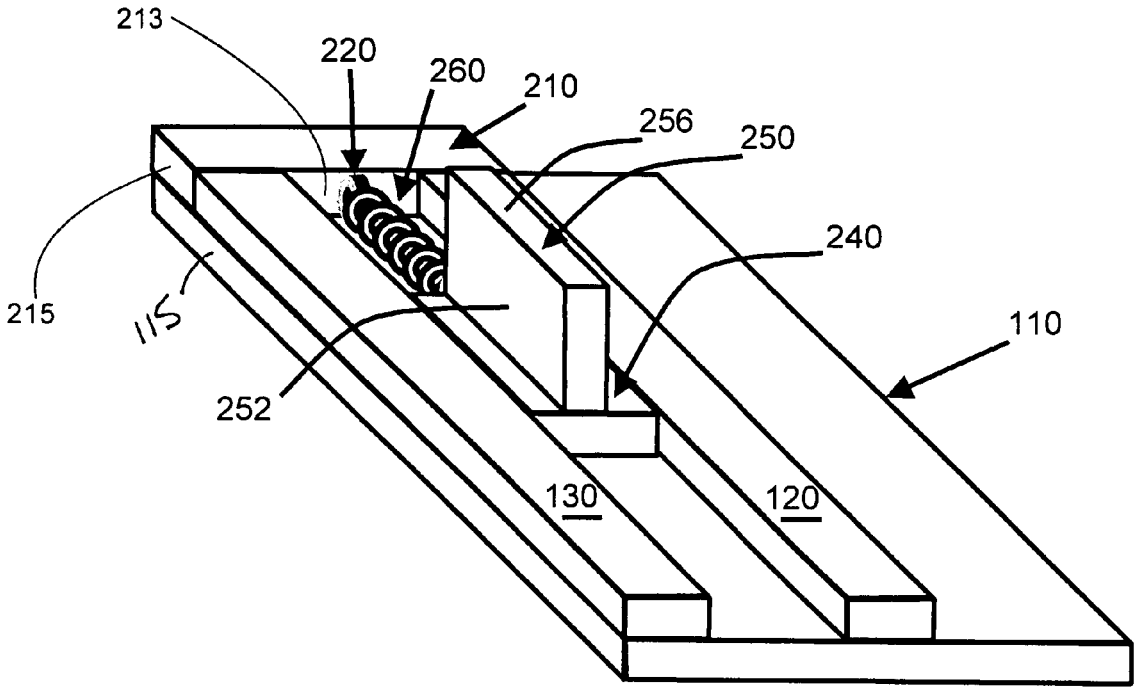
FIG. 2A is a perspective view showing additional elements of Applicant's holster assembly.
Figure 2B:
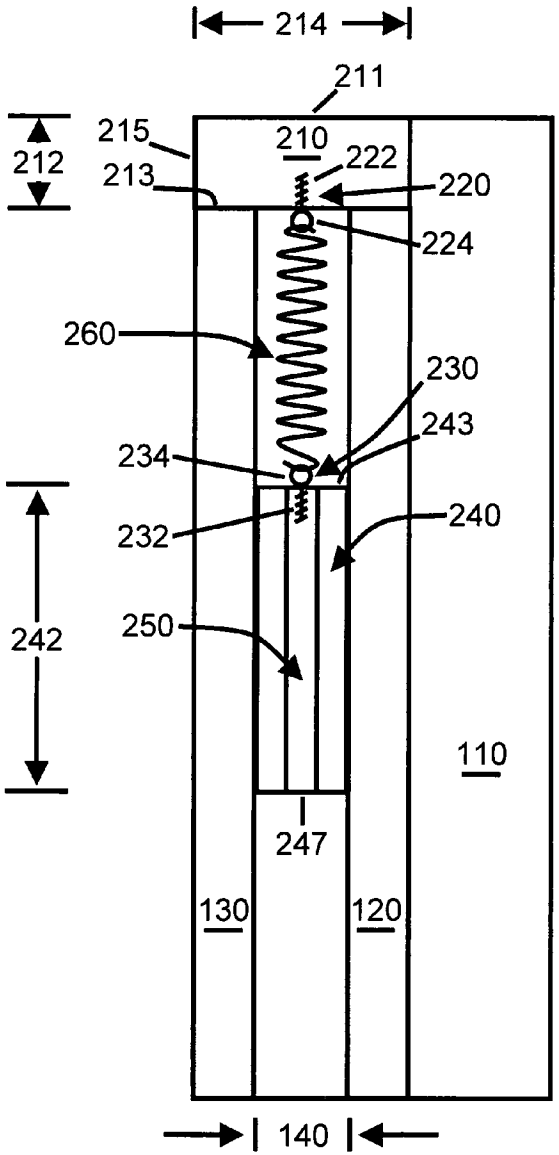
FIG. 2B is a top view showing the elements of FIG. 2A.
Figure 2C:
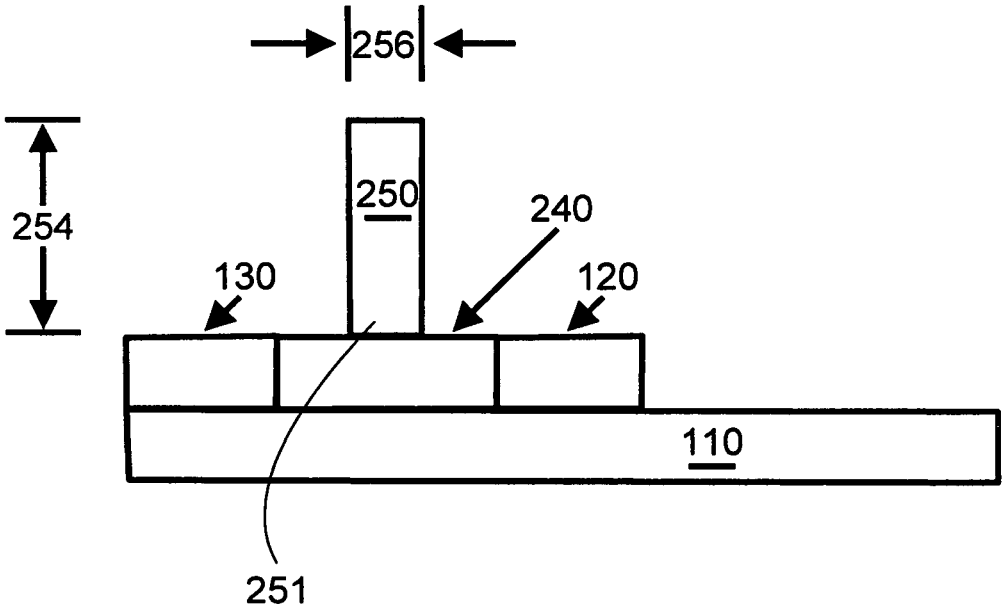
FIG. 2C is a first side view showing the elements of FIG. 2A.
Figure 2D:
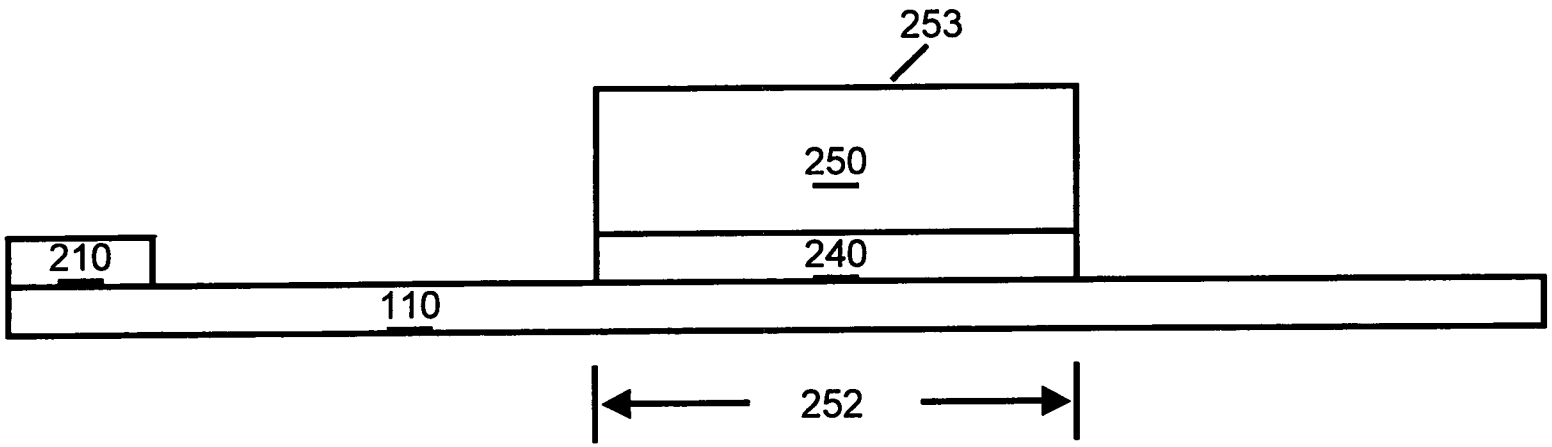
FIG. 2D is a second side view showing the elements of FIG. 2A.

Referring now to FIGS. 2A and 2B, planar member 210 is attached to base 110 such that side 211 is flush with side 111 (FIG. 1B) of base 110, and such that side 215 is flush with side 115 (FIG. 1B) of base 110, and such that side 213 abuts end 131 (FIG. 1B) of slide rail 130 and end 121 (FIG. 1B) of slide rail 120. Planar member 210 has a length 212. In certain embodiments, length 212 comprises the difference between distances 114 and 124. Planar member 210 has a width 214. In certain embodiments, width 214 comprises the sum of distances 126, 136, and 140. In certain embodiments, planar member 210 comprises thickness 128.

In certain embodiments, length 212 is between about 0.25 inches and about 1.5 inches. In certain embodiments, length 212 is about 0.75 inches. In certain embodiments, width 214 is between about 0.5 inches and about 3.0 inches. In certain embodiments, 214 is about 1.75 inches. In certain embodiments, planar member 210 is formed from a rigid material, such as without limitation wood, metal, molded plastic, leather, combinations thereof, and the like.

Planar member 210 is attached to base 110 using conventional attachment means, such as and without limitation adhesive bonding, welding, plastic welding, mechanical fasteners, i.e. nuts, bolts, and the like. In certain embodiments, planar member 210 and base 110 comprise an integrally molded assembly. In certain embodiments, planar member 210, slide rail 120, slide rail 130, and base 110, comprise an integrally molded assembly.

Spring attachment means 220 is disposed on side 213 of planar member 210 between slide rail 120 and slide rail 130. In certain embodiments, spring attachment means 220 comprises an annular assembly 224 disposed on one end of a threaded screw 222, wherein threaded screw 222 is disposed within planar member 210 such that annular assembly 224 extends outwardly from side 213.

Slide block 240 comprises end 243, end 247, length 242, and width 140. Slide block 240 is slidingly disposed between slide rail 120 and slide rail 130. Spring attachment means 230 is disposed on end 243 of slide block 240. In certain embodiments, spring attachment means 230 comprises an annular assembly 234 disposed on one end of a threaded screw 232, wherein threaded screw 232 is disposed within side 243 of slide block 240 such that annular assembly 234 extends outwardly from side 243. One end of spring 260 is attached to spring attachment means 220 and the opposite end of spring 260 is attached to spring attachment means 230. In certain embodiments, length 242 is between about 0.75 inches and about 4.0 inches. In certain embodiments, length 242 is about 2.5 inches.

Referring to FIGS. 2A, 2B, 2C, and 2D, riser 250 comprises a planar member having first end 251 attached to slide block 240, second end 253 extending upwardly from slide block 240, length 252, height 254, and width 256. In certain embodiments, length 252 is between about 0.75 inches and about 4 inches. In certain embodiments, length 252 is about 2.5 inches. In certain embodiments, width 256 is between about 0.12 inches and about 1 inch. In certain embodiments, width 256 is about 0.25 inches. In certain embodiments, height 254 is between about 0.25 inches and about 2 inches. In certain embodiments, height 254 is about 0.75 inches.

Figure 3A:
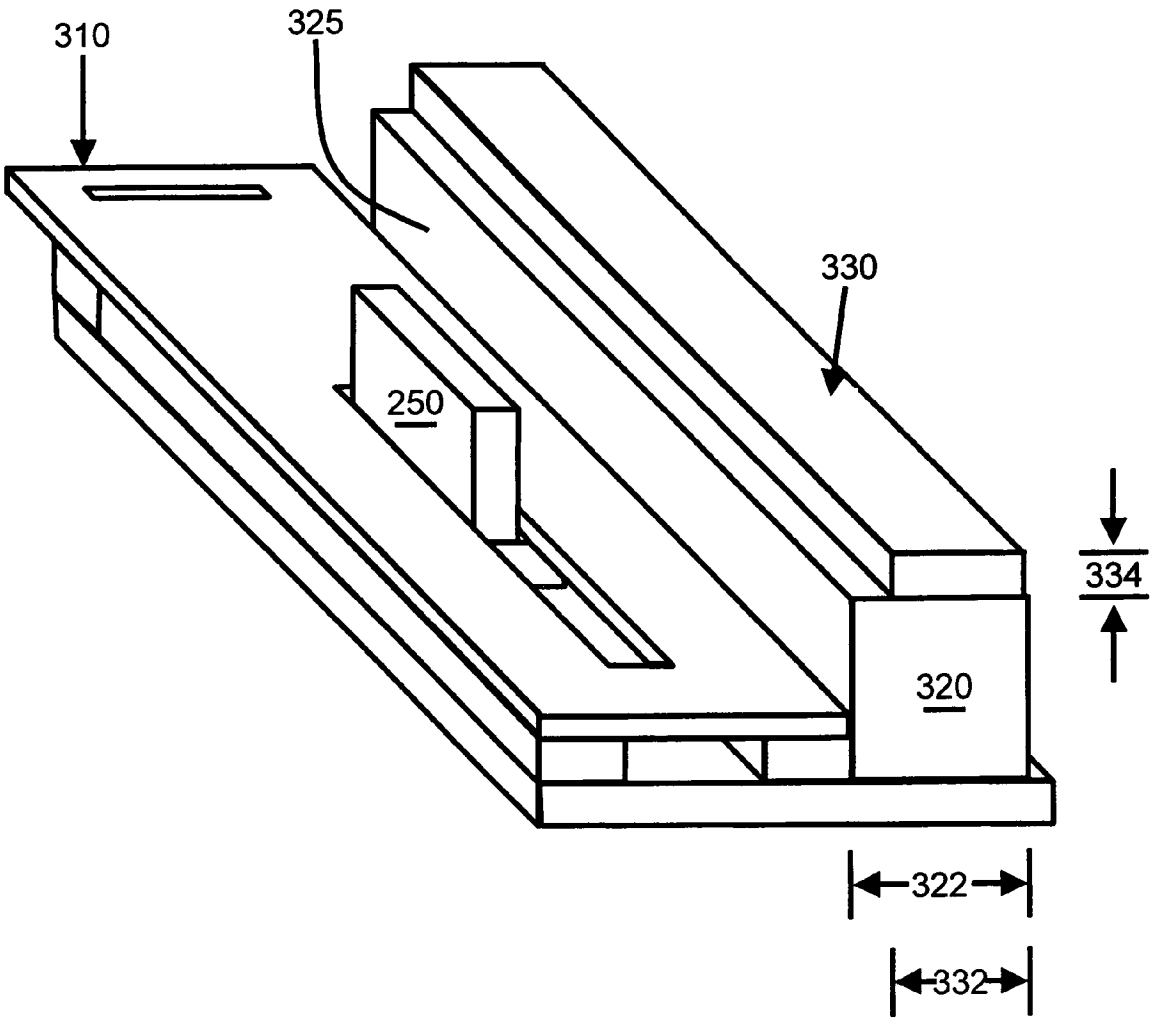
FIG. 3A is a perspective view of additional elements of Applicant's holster assembly.
Figure 3B:
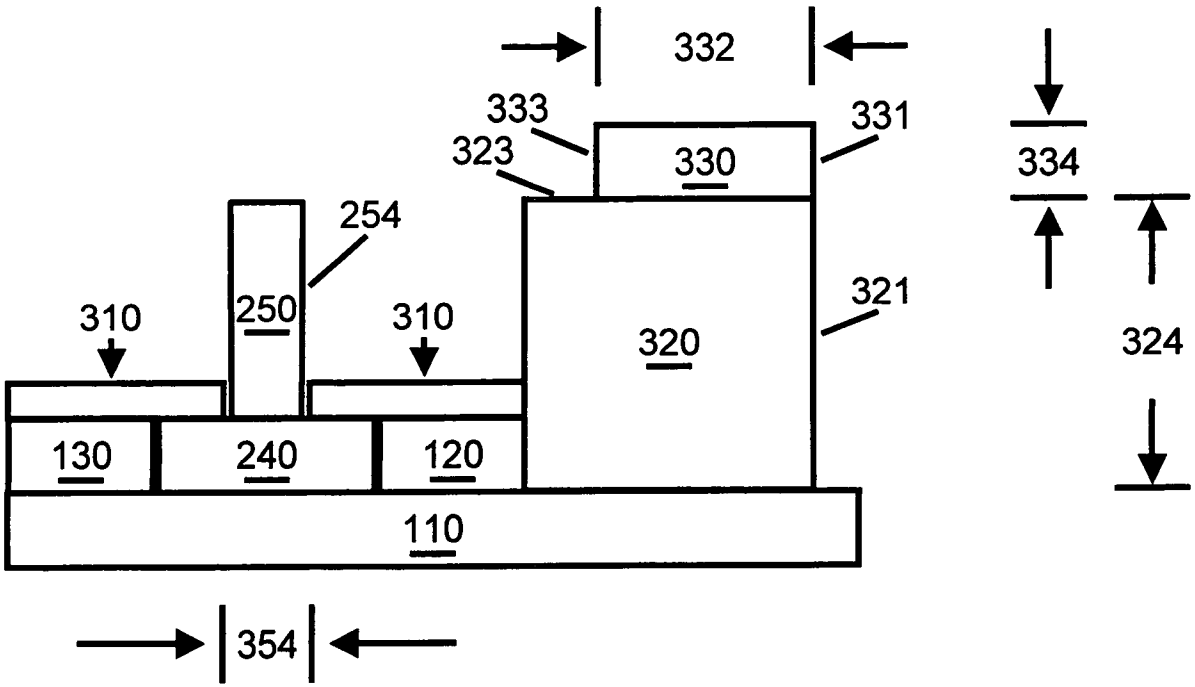
FIG. 3B is a side view showing the elements of FIG. 3A.
Figure 3C:
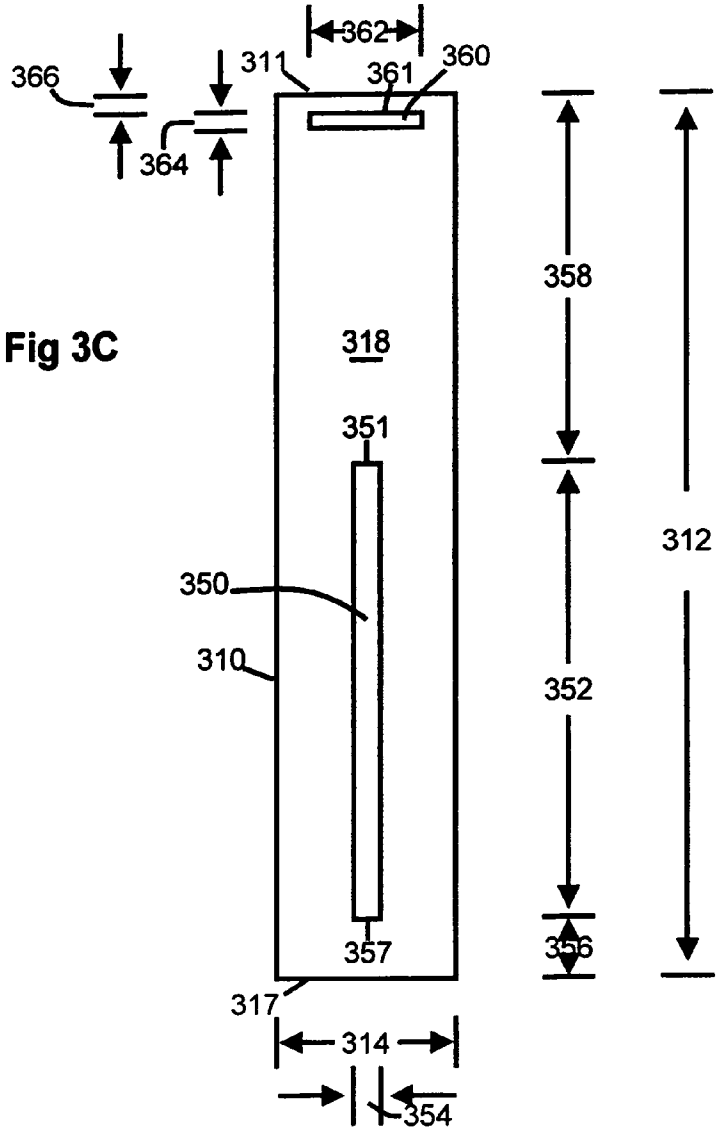
FIG. 3C is a top view showing one of the elements of FIG. 3A.

Referring now to FIGS. 3A, 3B, and 3C, cover 310 comprises length 312 and width 314. In certain embodiments, length 312 is between about 3.75 inches and about 16.75 inches. In certain embodiments, length 312 is about 8.75 inches. In certain embodiments, width 314 is between about 0.5 inches and about 3 inches. In certain embodiments, 314 is about 1.75 inches. In certain embodiments, cover 310 is formed from a rigid material, such as without limitation wood, metal, molded plastic, leather, combinations thereof, and the like. Cover 310 is disposed on the top surface slide rail 120, and on the top surface of slide rail 130. Cover 310 is attached to the top surface slide rail 120, and on the top surface of slide rail 130 using conventional attachment means, such as and without limitation adhesive bonding, welding, plastic welding, mechanical fasteners, i.e. nuts, bolts, and the like.

Cover 310 is formed to include aperture 350 extending therethrough. Aperture 350 has length 352 and width 354. In certain embodiments, length 352 is between about 2 inches and about 15 inches. In certain embodiments, length 352 is about 4.6 inches. In certain embodiments, width 354 is between about 0.13 inches and about 1.1 inches. In certain embodiments, width 354 is about 0.3 inches.

End 351 of aperture 350 is located a distance 358 from end 311 of cover 310. End 357 of aperture 350 is located a distance 356 from end 317 of cover 310. In certain embodiments, distance 358 is between about 2 inches and about 8 inches. In certain embodiments, distance 358 is about 4 inches. In certain embodiments, distance 356 is between about 0.2 inches and about 0.5 inches. In certain embodiments, distance 356 is about 0.3 inches.

Cover 310 is further formed to include aperture 360 extending therethrough. Aperture 360 has length 362 and width 364. In certain embodiments, length 362 is between about 0.5 inches and about 1.5 inches. In certain embodiments, length 362 is about 1 inch. In certain embodiments, width 364 is between about 0.1 inches and about 0.5 inches. In certain embodiments, width 364 is about 0.2 inches. End 361 of aperture 360 is located a distance 366 from end 311 of cover 310. In certain embodiments, distance 366 is between about 0.25 inches and about 1 inch. In certain embodiments, distance 366 is about 0.5 inches.

Stiffener 320 comprises a planar member having a length 114 (FIG. 1B), width 322 and height 324. In certain embodiments, width 322 is between about 0.5 inches and about 1.5 inches. In certain embodiments, width 322 is about 1 inches. In certain embodiments, height 324 is between about 0.5 inches and about 1.5 inches. In certain embodiments, height 324 is about 1 inch.

In certain embodiments, stiffener 320 is attached to base 110 such that side 321 is flush with side 117 (FIG. 1B) of base 110. In certain embodiments, stiffener 320 is formed from a rigid material comprising wood, metal, glass, leather, combinations thereof, and the like. In certain embodiments, stiffener 320 is attached to base 110 using conventional attachment means, such as and without limitation adhesive bonding, welding, plastic welding, mechanical fasteners, i.e. nuts, bolts, and the like.

Mounting rail 330 has a length 114 (FIG. 1B), width 332, and thickness 334. In certain embodiments, width 332 is between about 0.5 inches and about 1.5 inches. In certain embodiments, width 322 (332) is about 0.75 inches. In certain embodiments, thickness 334 is between about 0.12 inches and about 0.5 inches. In certain embodiments, thickness 334 is about 0.25 inches.

In certain embodiments, mounting rail 330 is attached to stiffener 320 using conventional attachment means, such as and without limitation adhesive bonding, welding, plastic welding, mechanical fasteners, i.e. nuts, bolts, and the like. In certain embodiments, base 110, slide rail 120, slide rail 130, stiffener 320, and mounting rail 330, comprise an integrally molded assembly.

Figure 4A:
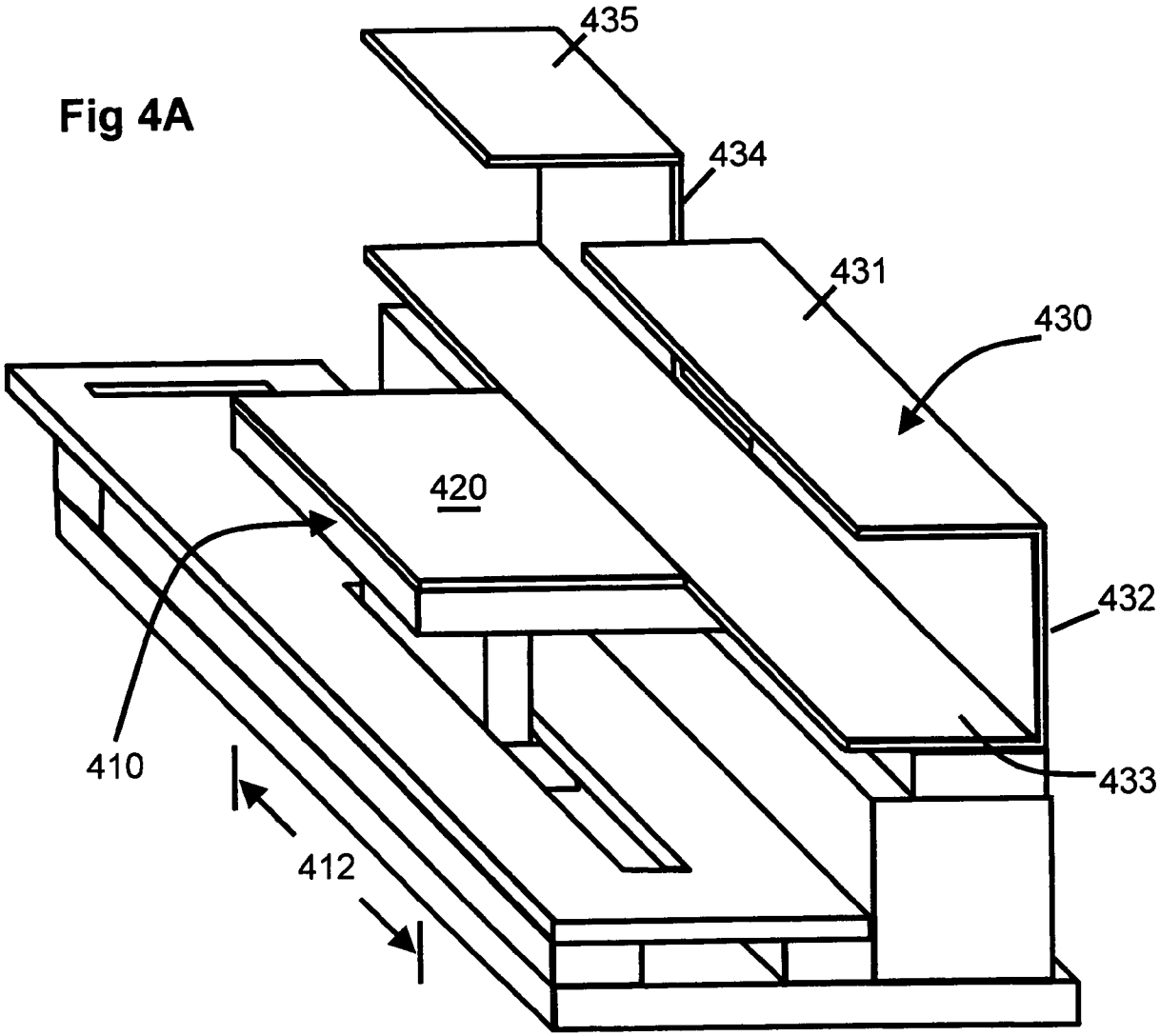
FIG. 4A is a perspective view of additional elements of Applicant's holster assembly.
Figure 4B:
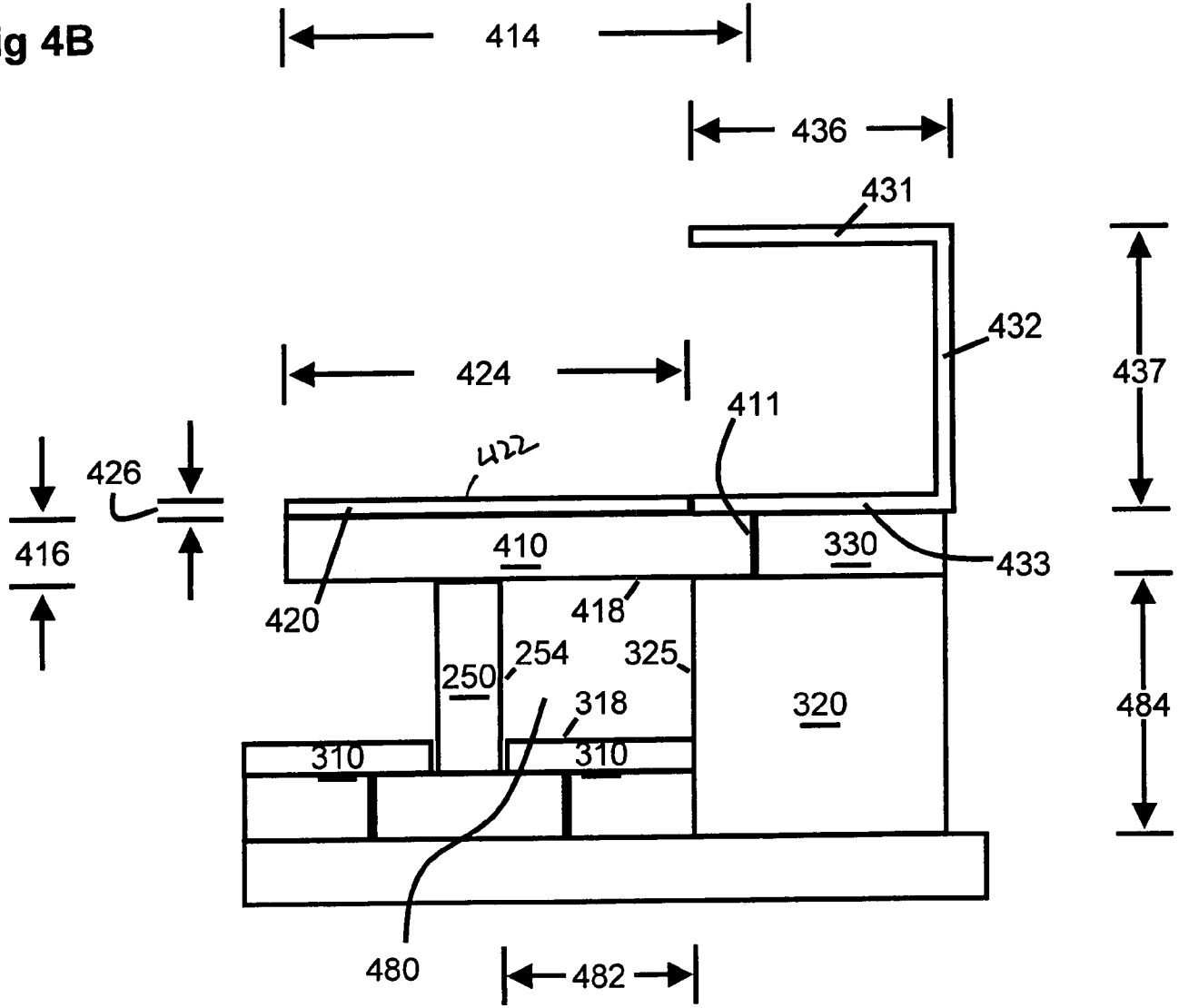
FIG. 4B is a side view showing the elements of FIG. 4A.

Referring now to FIGS. 4A and 4B, slide platform 410 is mounted on top of riser 250. Slide platform 410 has a length 412, width 414, and thickness 416. In certain embodiments, length 412 is between about 1 inch and about 4 inches. In certain embodiments, length 412 is about 2.5 inches. In certain embodiments, width 414 is between about 1 inch and about 4 inches. In certain embodiments, width 414 is about 2.5 inches. In certain embodiments, thickness 416 is between about 0.05 inches and about 0.50 inches. In certain embodiments, thickness 416 is about 0.2 inches.

Side 411 of slide platform 410 is moveably disposed against side 333 (FIG. 3B) of mounting rail 330, and is moveably disposed against a portion of top 323 (FIG. 3B) of stiffener 320. Cover plate 420 comprises a planar member. Cover plate 420 is disposed on the top surface of slide platform 410.

Cover plate 420 has length 412 (FIG. 4A), width 424, and thickness 426. In certain embodiments, width 424 is between about 0.7 inches and about 3.7 inches. In certain embodiments, width 424 is about 2.2 inches. In certain embodiments, thickness 426 is between about 0.05 inches and about 0.3 inches. In certain embodiments, thickness 426 is about 0.09 inches.

Figure 4C:
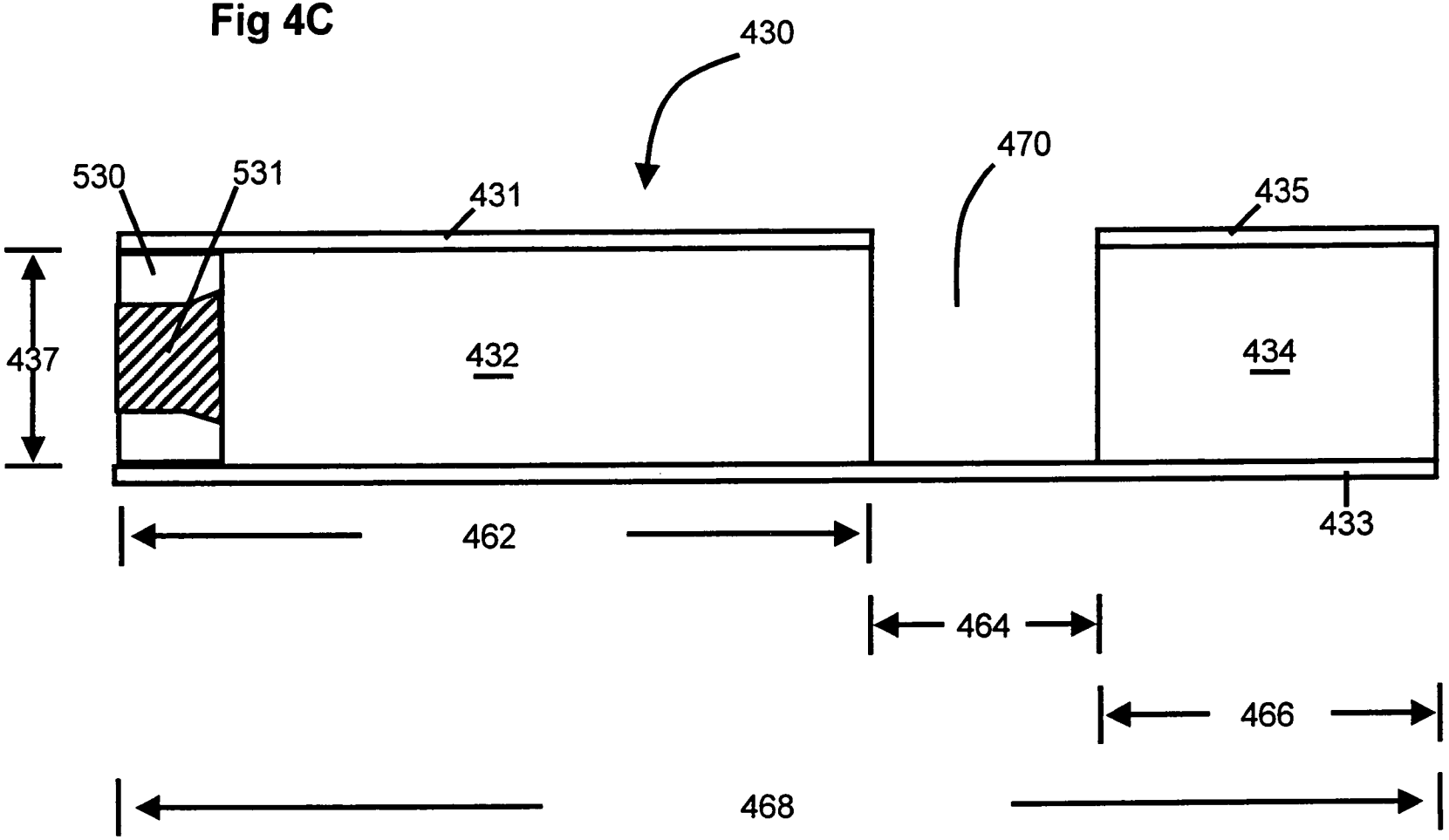
FIG. 4C is a side view of one of the elements of FIG. 4A.
Figure 5A:
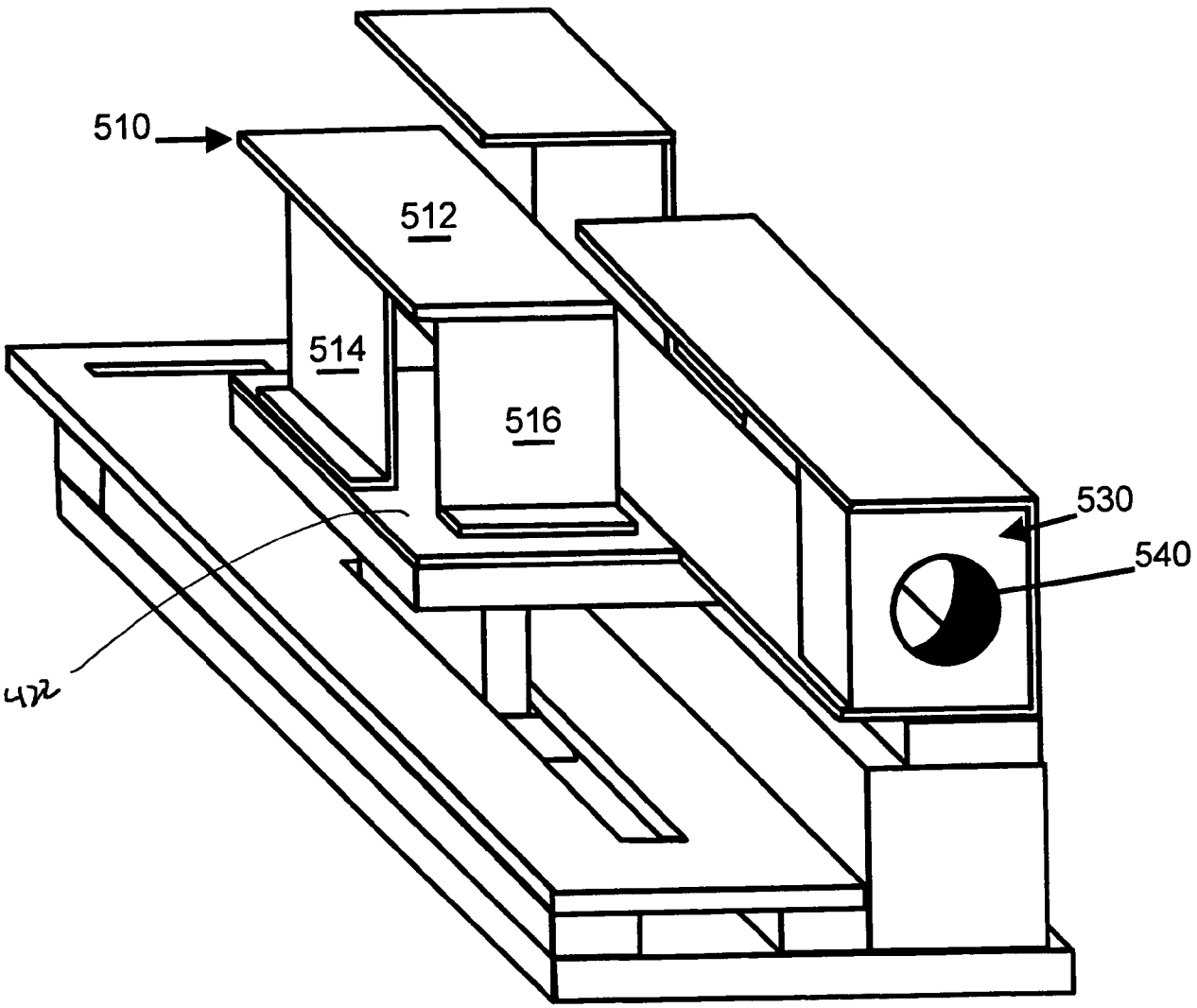
FIG. 5A is a perspective view showing additional elements of Applicant's holster assembly.
Figure 5B:
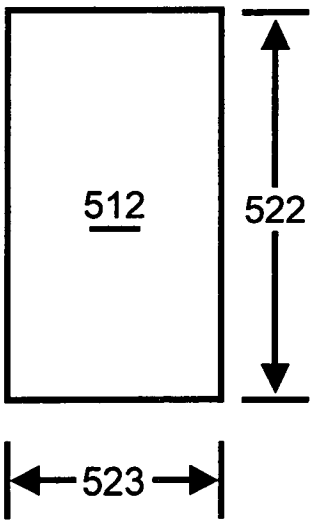
FIG. 5B is a top view of one of the elements of FIG. 5A.
Figure 5C:
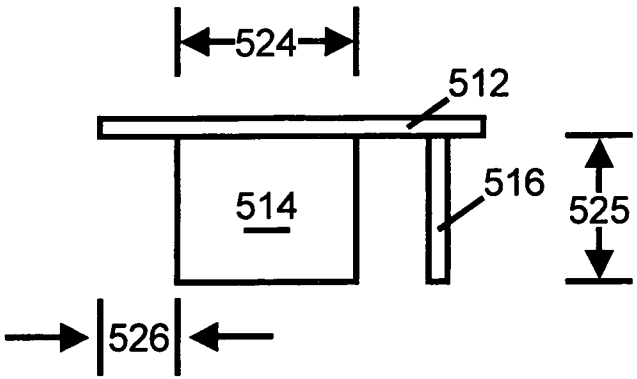
FIG. 5C is a first side view showing certain of the elements of FIG. 5A.
Figure 5D:
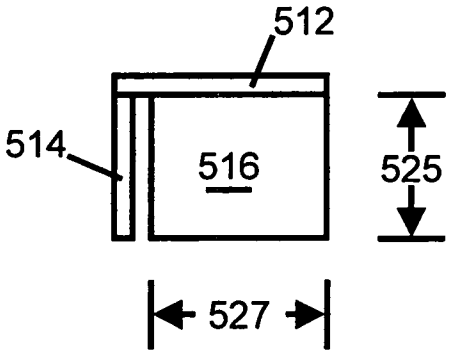
FIG. 5D is a second side view showing certain of the elements of FIG. 5A.

Referring now to FIGS. 4A, 4B, and 4C, barrel housing 430 comprises base planar member 433, side planar members 432 and 434, and top planar members 431 and 435. Housing 430 is mounted on the top surface of mounting rail 330 such that the outer surface of side members 432 and 434 are flush with side 331 (FIG. 3B) of mounting rail 330. In certain embodiments, housing 430 comprises an integrally molded assembly. In other embodiments, base planar member 433, side planar members 432 and 434, and top planar members 431 and 435, comprise separate elements which are attached to one another was described herein using conventional attachment means. In certain embodiments, base 110, slide rail 120, slide rail 130, stiffener 320, mounting rail 330, and housing 430 comprise an integrally molded assembly.

Base planar member 433 has a length 468, width 436, and thickness 426. In certain embodiments, length 468 is between about 3 inches and about 15 inches. In certain embodiments, length 468 is about 8 inches. In certain embodiments, width 436 is between about 0.5 inches and about 3 inches. In certain embodiments, width 436 is about 1.25 inches.

Side planar member 432 is attached to a first side of base member 433, and extends upwardly therefrom. Side planar member 432 has a length 462, a height 437, and a thickness 426. In certain embodiments, length 462 is between about 2 inches and about 8 inches. In certain embodiments, length 462 is about 3.4 inches. In certain embodiments, height 437 is between about 0.5 inches and about 3 inches. In certain embodiments, height 437 is about 1.2 inches.

Side planar member 434 is attached to the first side of base member 433, and extends upwardly therefrom. Side planar member 434 has a length 466, a height 437, and a thickness 426. In certain embodiments, length 466 is between about 1.5 inches and about 4 inches. In certain embodiments, length 466 is about 2.8 inches.

Side planar member 432 is separated from side planar member 434 by a gap 470. Gap 470 has a length 464. In certain embodiments, length 464 is between about 1 inches and about 2.5 inches. In certain embodiments, length 464 is about 1.7 inches.

Top planar member 431 is attached to side planar member 432 and extends inwardly therefrom. Top planar member 431 has a length 466, a width 437, and a thickness 426. Top planar member 435 is attached to side planar member 434 and extends inwardly therefrom. Top planar member 435 has a length 466, a width 436, and a thickness 426. Top planar member 431 is separated from top planar member 435 by gap 470.

Figure 7:
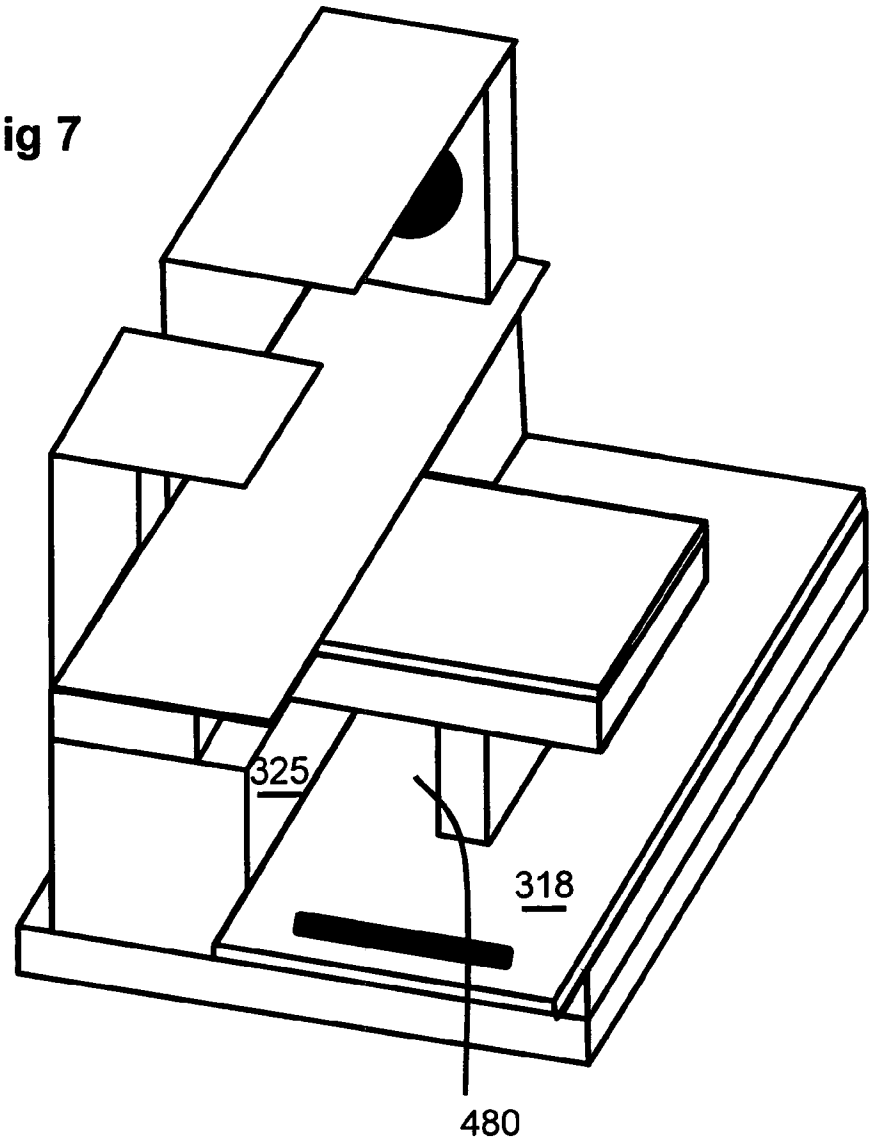
FIG. 7 is a perspective view of Applicant's holster.

Referring now to FIGS. 4B and 7, top surface 318 of cover 310, side 254 of riser 250, bottom surface 418 of slide platform 410, and side 325 of stiffener 320 define thumb channel 480. Thumb channel 480 has a width 482 and height 484. In certain embodiments, width 482 is between about 0.5 inches and about 2 inches. In certain embodiments, width 482 is about 0.75 inches. In certain embodiments, height 484 is between about 0.5 inches and about 2 inches. In certain embodiments, height 484 is about 0.6 inches. Referring now to FIGS. 4B, 6A, 6B, and 7, thumb channel 480 provides space for the user's thumb when the user grasps firearm 610 while firearm 610 is disposed in holster 600.

Referring now to FIGS. 5A, 5B, 5C, and 5D, trigger guard 510 comprises top member 512, side member 514, and side member 516. In certain embodiments, trigger guard 510 comprises an integrally molded assembly. In other embodiments, top member 512, side member 514, and side member 516, are separately formed and then attached as shown using conventional attachment means.

Side members 514 and 516 are attached to top surface 422 of cover plate 420 and extend upwardly therefrom. Top member 512 is attached to the top portions of side members 514 and 516.

Top member 512 has a length 522, a width 523, and a thickness 426. In certain embodiments, length 522 is between about 1 inch and about 4 inches. In certain embodiments, length 522 is about 3 inches. In certain embodiments, width 523 is between about 1 inch and about 3 inches. In certain embodiments, width 523 is about 1.5 inches.

Side member 514 has a length 524, height 525, and thickness 426 (FIG. 4B). Top portion 512 overlaps side member 514 by a distance 526. In certain embodiments, length 524 is between about 1 inches and about 3 inches. In certain embodiments, length 524 is about 1.5 inches. In certain embodiments, height 525 is between about 0.5 inches and about 2 inches. In certain embodiments, height 525 is about 1 inches. In certain embodiments, distance 526 is between about 0.5 inches and about 3 inches. In certain embodiments, distance 526 is about 1 inch.

Side member 516 has a length 527, height 525, and thickness 426 (FIG. 4B). In certain embodiments, length 527 is between about 0.5 inches and about 3 inches. In certain embodiments, length 527 is about 1 inch.

Slide block 240, riser 250, slide platform 410, cover plate 420, and trigger guard 510, comprise a moveable trigger housing mechanism, wherein that moveable trigger housing mechanism is slidingly disposed on base 110 (FIG. 1A, 1B, 2A, 2B, 2C, 2D, 3B). Spring 220 (FIGS. 2A, 2B, 10, 11) imposes a first force in a first direction, wherein that first force holds trigger housing mechanism in a first position wherein side 255 (FIG. 8) of riser 250 is adjacent to, and in contact with, side 351 (FIGS. 3C, 8) of aperture 350 (FIG. 3C).

Figure 9:
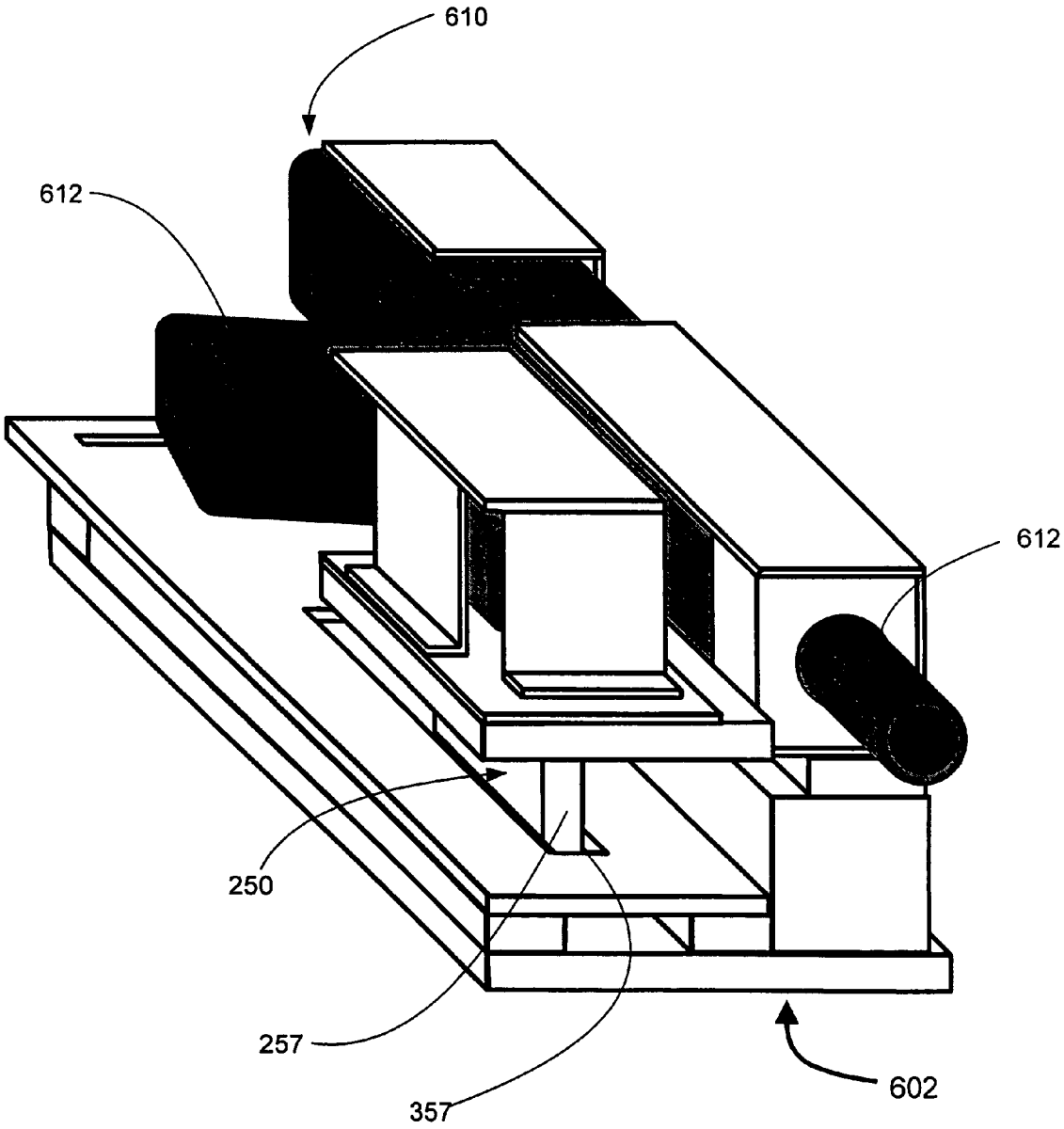
FIG. 9 is a perspective view of the pistol of FIG. 6D removeably disposed in Applicant's holster assembly, wherein the pistol and the holster assembly are each in a second configuration.

If a second force in a second direction is imposed on the trigger housing mechanism, wherein that second force is greater than the first force, and wherein the second direction is opposite to the first direction, then the trigger housing mechanism can be slidingly moved from the first position to a second position, wherein side 257 (FIG. 9) of riser 250 is adjacent to, and in contact with, side 357 (FIGS. 3C, 9) of aperture 350.

Barrel port block 530 is formed to include aperture 540 extending therethrough. Barrel port block 530 is disposed in the distal end of housing 430. In certain embodiments, aperture 540 has a diameter between about 0.5 inches and about 1 inches. In certain embodiments, aperture 540 has a diameter of about 0.7 inches.

Figure 12:
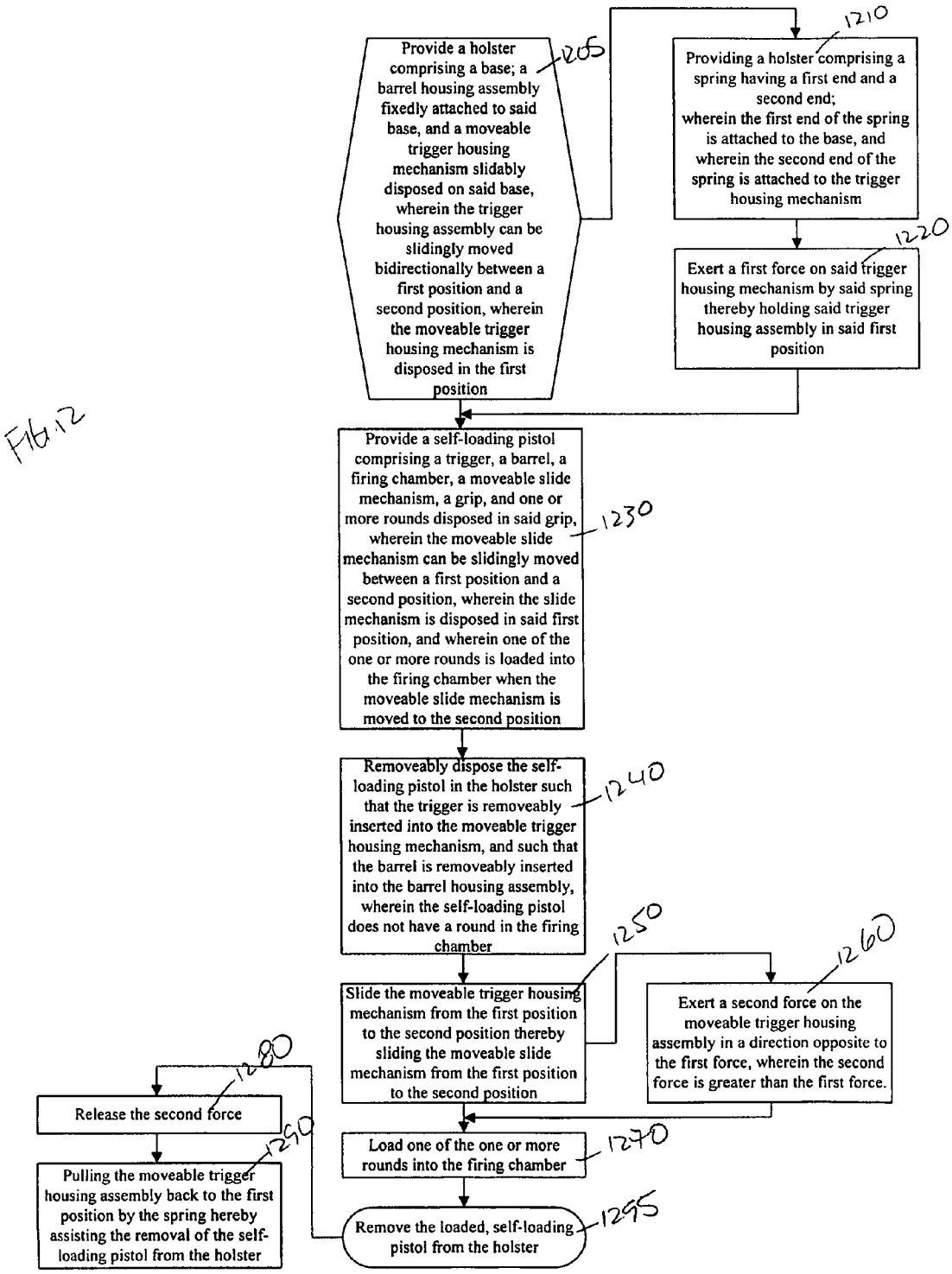
FIG. 12 is a flow chart summarizing the steps of Applicant's method.

Applicant's invention comprises a method to use a self-loading pistol, wherein that pistol as initially holstered using Applicant's holster assembly and method does not have a round in the firing chamber. FIG. 12 summarizes the steps of Applicant's method.

Figure 8:
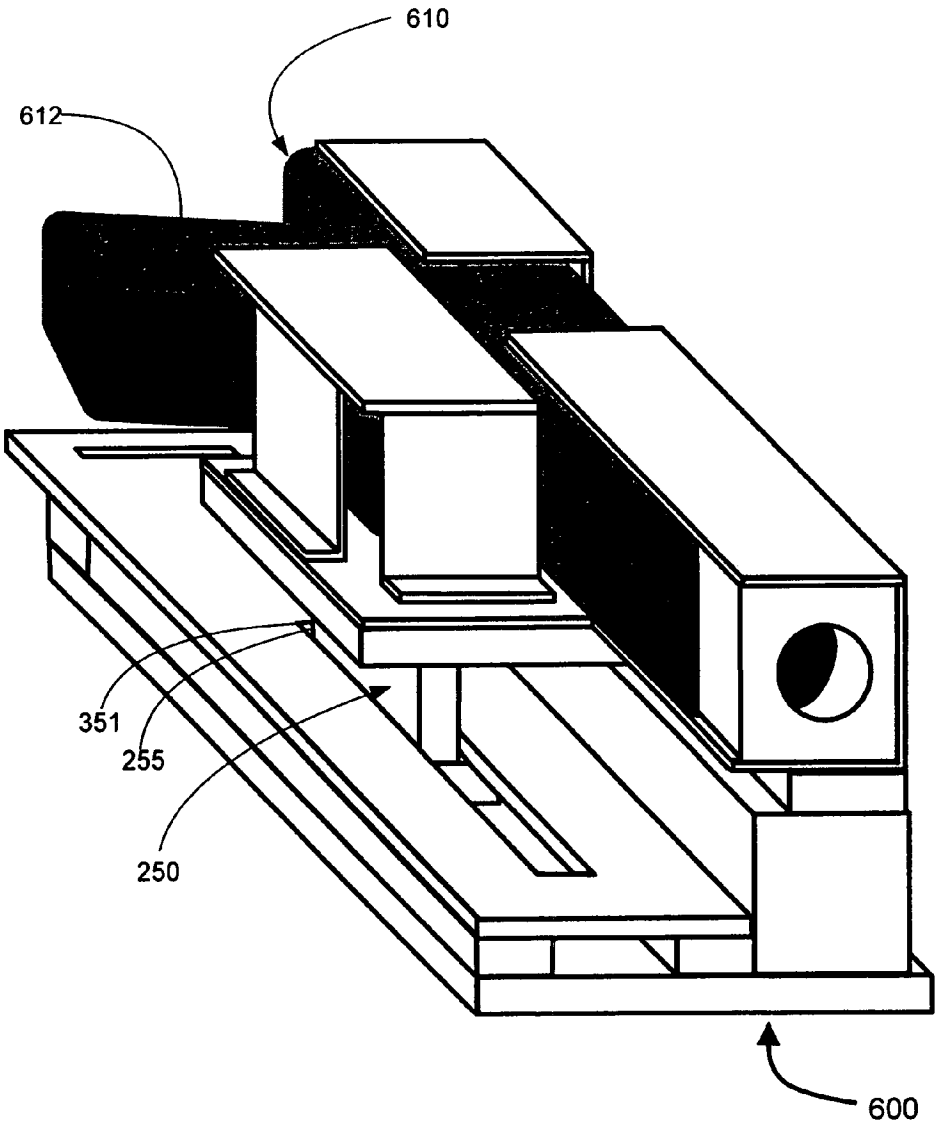
FIG. 8 is a perspective view the pistol of FIG. 6C removeably disposed in Applicant's holster assembly, wherein the pistol and the holster assembly are each in a first configuration.

Referring now to FIGS. 8 and 12, in step 1205 Applicant's method provides a holster, such as Applicant's holster assembly 600 as described herein, comprising a base; a barrel housing assembly fixedly attached to said base, and a moveable trigger housing mechanism slidably disposed on said base, wherein the trigger housing mechanism can be slidingly moved bidirectionally between a first position and a second position, wherein the moveable trigger housing mechanism is disposed in the first position shown in FIG. 8.

Figure 10:
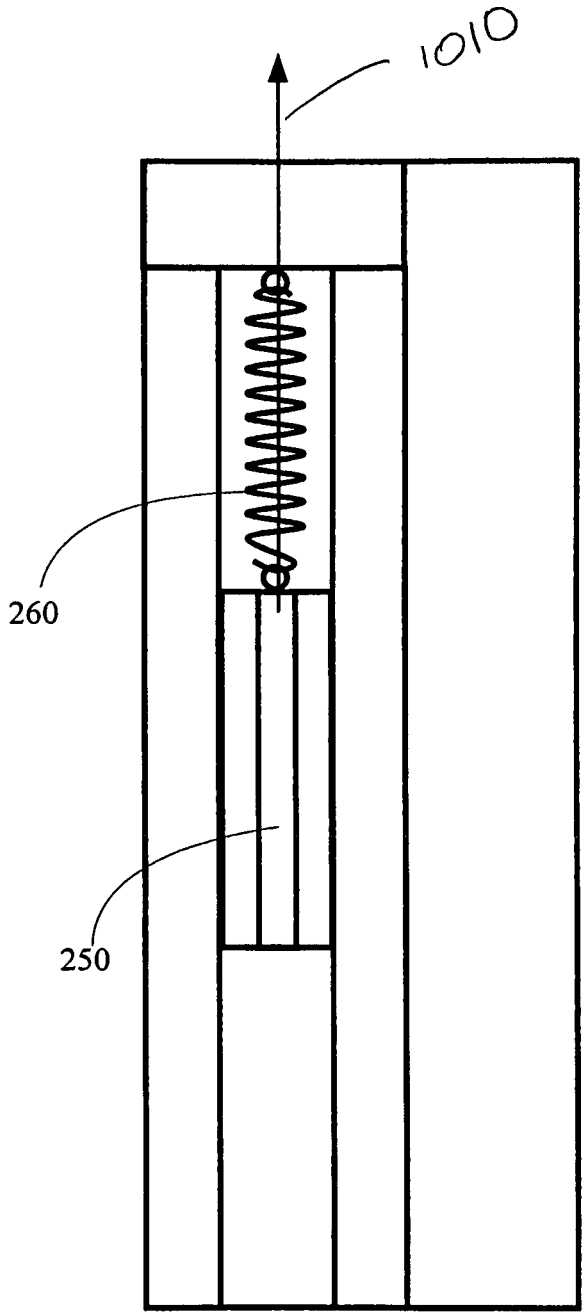
FIG. 10 shows the configuration of a spring component of Applicant's holster assembly when that holster assembly is disposed in the first configuration of FIG. 8.
Figure 11:
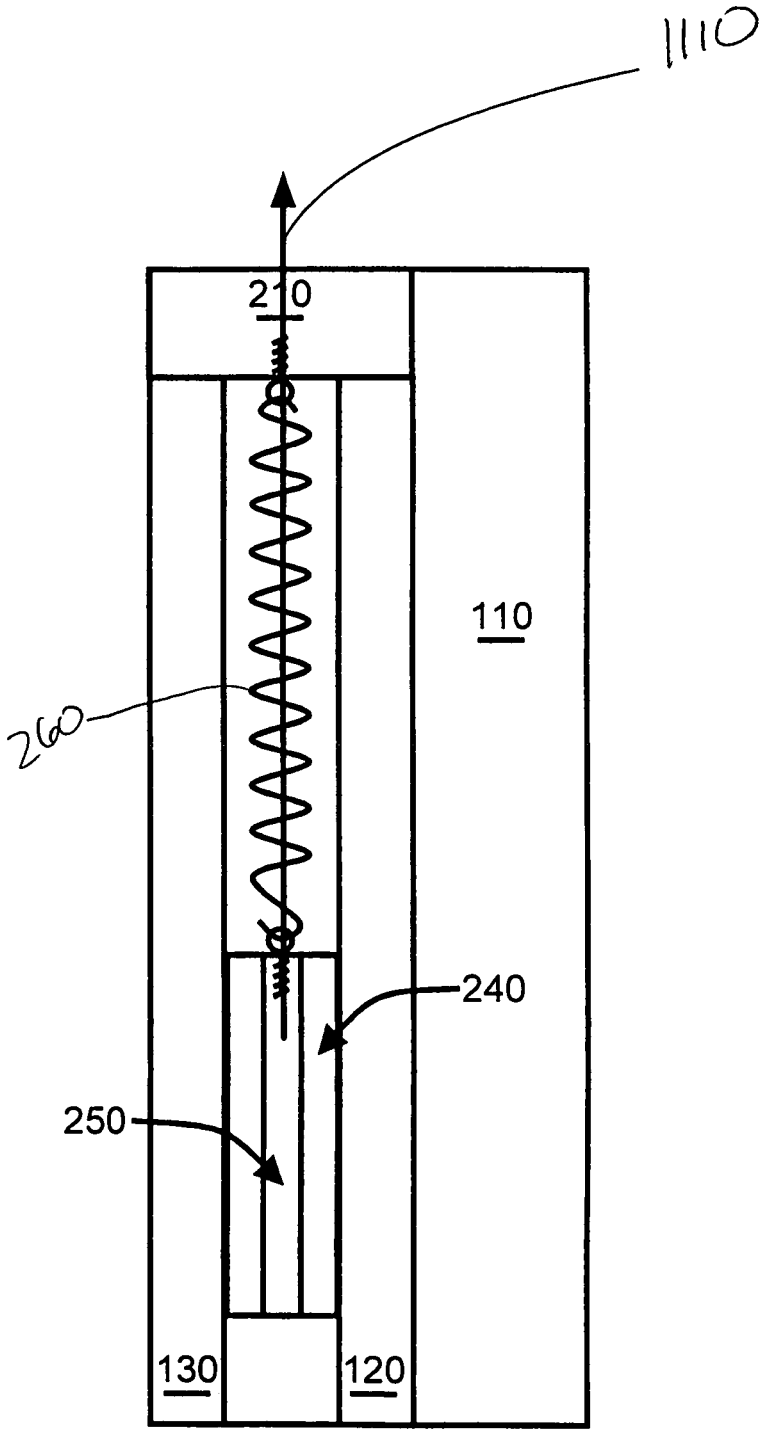
FIG. 11 shows the configuration of a spring component of Applicant's holster assembly when that holster assembly is disposed in the second configuration of FIG. 9.

In certain embodiments, step 1205 further comprises steps 1210 and 1220. Referring now to FIGS. 8, 10, and 12, in step 1210 Applicant's method provides a holster comprising a spring, such as spring 260 (FIGS. 2A, 2B, 10, 11A, 11B), having a first end and a second end, wherein the first end of the spring is attached to the base, such as base 110, and wherein the second end of the spring is attached to the trigger housing mechanism, such as Applicant's trigger housing mechanism comprising slide block 240, riser 250, slide platform 410, cover plate 420, and trigger guard 510.

In step 1220, spring 260 imposes a first force 1010 in a first direction, wherein that first force holds trigger housing mechanism in a first position wherein side 255 (FIG. 8) of riser 250 is adjacent to, and in contact with, side 351 (FIGS. 3C, 8) of aperture 350 (FIG. 3C).

In step 1230, Applicant's method provides a self-loading pistol comprising a trigger, a barrel, a firing chamber, a moveable slide mechanism, a grip, and one or more rounds disposed in the grip, wherein the moveable slide mechanism can be slidingly moved between a first position and a second position, wherein the slide mechanism is disposed in the first position. One of the one or more rounds is loaded into the firing chamber when the moveable slide mechanism is moved to the second position As those skilled in the art will appreciate, a self-loading pistol reloads the firing chamber with a new round automatically each time the weapon is fired, without additional action by the user. This is accomplished by recoil. As those skilled in the art will further appreciate, a semi-automatic pistol will fire only one shot per trigger pull, in contrast to a "fully automatic" pistol which continues to fire as long as the trigger is held back or until all rounds have been fired.

Referring now to FIG. 6C, self-loading pistol 610 comprises grip 612, slide mechanism 614, trigger 616, and barrel 618. In certain embodiments, pistol 610 further comprises a clip mechanism disposed within grip 612, wherein that clip mechanism is designed to hold a plurality of rounds, i.e. bullets, and to feed a round into the firing chamber each time a round is fired.

Referring now to FIG. 6D, in order to load a round into the firing chamber slide mechanism 614 is moved backwardly manually to configuration 611, thereby causing the clip mechanism to load a round into the firing chamber. In certain embodiments, moving slide mechanism 614 backwardly also cocks a trigger. After loading a round, and optionally cocking a trigger, an internal spring mechanism pulls slide mechanism forward to configuration 610 (FIG. 6C) with a round loaded in the firing chamber. As described above, after firing a first round, pistol 610 automatically reloads until the supply of rounds disposed in the clip assembly is depleted.

Referring once again to FIG. 12, in step 1240 Applicant's method removeably disposes the self-loading pistol of step 1230 in the holster of step 1205 such that the trigger is removeably inserted into the moveable trigger housing mechanism, and such that the barrel is removeably inserted into the barrel housing assembly, wherein the self-loading pistol does not have a round in the firing chamber. Referring now to FIGS. 6C and 8, FIG. 8 shows pistol 610 removeably disposed in Applicant's holster assembly 600 such that barrel portion 618 is removeably disposed in the barrel housing portion of Applicant's holster, and such that trigger 616 is removeably disposed in Applicant's trigger housing mechanism, as that mechanism is described herein.

In step 1250, Applicant's method slides the moveable trigger housing mechanism from the first position to the second position thereby sliding the moveable slide mechanism 614 from the first position of FIG. 6C to the second position of FIG. 6D. Referring now to FIGS. 6D, 8, 9, and 11, by exerting a downward force on grip 612, Applicant's trigger housing mechanism comprising slide block 240, riser 250, slide platform 410, cover plate 420, and trigger guard 510 is moved from the first position shown in FIG. 8 to the second position shown in FIG. 9, thereby placing pistol in the loading configuration shown in FIG. 6D.

Sliding Applicant's trigger housing mechanism to the second position elongates spring 260 as shown in FIG. 1. As those skilled in the art will appreciate, Hooke's law teaches that the force exerted by a spring is proportional to the elongation of that spring. In the elongated configuration of FIG. 11, spring 260 exerts a first force 1110 on slide block 240 in the direction shown, wherein slide block 240 comprises a portion of Applicant's trigger housing mechanism. In order to move the trigger housing mechanism to the second position of FIGS. 9 and 11B, a second force greater than force 1120 must be exerted downwardly on pistol grip 612.

Once pistol 610 is placed in the loading configuration of FIG. 6D, in step 1270, a round is disposed in the firing chamber thereby "loading" the pistol. In step 1295, Applicant's method removes the loaded pistol from Applicant's holster assembly. In certain embodiments, step 1295 comprises steps 1280 and 1290. In step 1280, Applicant's method releases the second force exerted in step 1260. In step 1290, first force 1110 pulls the trigger housing mechanism back to the first position thereby assisting the removal of pistol 610 from holster assembly 600.

In addition to the one-handed operation described above wherein a user can load, cock, and fire pistol 610 using only one hand, Applicant's holster assembly 600 also allows the user to unload pistol 610 using one hand. After the user has cycled, drawn, and fired pistol 610, there may be a live round in the firing chamber. The user then, using the hand carrying pistol 610 causes pistol 610 to eject the clip, and any live rounds disposed therein, from grip portion 612, and then using that same hand inserts pistol 600 into holster assembly 600, and using that same hand pushes pistol 600 downwardly such that pistol 600 is disposed in the configuration of FIG. 6D. Disposing pistol 610 in the configuration of FIG. 6D causes the live round in the firing chamber to be ejected through slot 470 (FIG. 4C) in barrel housing 430 (FIG. 4C), thereby unloading pistol 600. Another live round cannot be placed in the firing chamber because the clip has been removed.

Moreover, in an emergency the user may forget that pistol 600 has a round in the firing chamber when the user cycles the pistol using Applicant's holster assembly 600. In such an event, the round already disposed in the firing chamber is ejected, and a different live round is placed into the chamber from the loaded magazine or clip.

In addition to using Applicant's holster assembly to implement Applicant's method recited hereinabove, holster assembly 600 (FIGS. 6A, 6B) can also be used to carry pistol 610 (FIG. 6B) without using Applicant's method. In such an embodiment, pistol 600 is simple withdrawn from holster assembly 600 without pushing that pistol downwardly to load a round in the firing chamber, and without engaging the upward pull of elongated spring 260 to assist removal of the pistol from the holster assembly.

Whether being used as a prior art holster device, or being used to implement Applicant's method, Applicant's holster assembly 600 can be fashioned to work with either a right-handed carry, or a left-handed carry. By "right-handed carry," Applicant's mean that pistol 610 is grasped using the right hand, pushed downwardly using the right hand, and removed from holster assembly 600 using the right hand.

While the preferred embodiments of the present invention have been illustrated in detail, it should be apparent that modifications and adaptations to those embodiments may occur to one skilled in the art without departing from the scope of the present invention as set forth in the following claims.

I claim:

1. A method to carry and use a self-loading pistol, comprising the steps of:

providing a holster comprising a base; a barrel housing assembly fixedly attached to said base, and a moveable trigger housing mechanism slidably disposed on said base, wherein said trigger housing mechanism can be slidingly moved bidirectionally between a first position and a second position, wherein said moveable trigger housing mechanism is disposed in said first position;

providing a self-loading pistol comprising a trigger, a barrel, a firing chamber, a moveable slide mechanism, a grip, and one or more rounds disposed in said grip, wherein said moveable slide mechanism can be slidingly moved between a first position and a second position, wherein said slide mechanism is disposed in said first position, and wherein one of said one or more rounds is loaded into said firing chamber when said moveable slide mechanism is moved to said second position;

removeably disposing said self-loading pistol in said holster such that said trigger is removeably inserted into said moveable trigger housing mechanism, and such that said barrel is removeably inserted into said barrel housing assembly, wherein said self-loading pistol does not have a round in the firing chamber, and wherein said self-loading pistol without a round in the firing chamber can be removed from said holster without moving said moveable trigger housing mechanism;

sliding said moveable trigger housing mechanism from said first position to said second position thereby moving said moveable slide mechanism from said first position to said second position;

loading one of said one or more rounds into said firing chamber;

removing said self-loading pistol from said holster.

2. The method of claim 1, wherein said providing a holster step further comprises the steps of:

providing a holster comprising a spring having a first end and a second end;

wherein said first end of said spring is attached to said base, and wherein said second end of said spring is attached to said trigger housing mechanism.

3. The method of claim 2, further comprising the steps of:

exerting a first force on said trigger housing mechanism by said spring thereby holding said trigger housing mechanism in said first position;

wherein said sliding said moveable trigger housing mechanism from said first position to said second position step further comprises exerting a second force on said moveable trigger housing mechanism in a direction opposite to said first force, wherein said second force is greater than said first force.

4. The method of claim 3, wherein removing said self-loading pistol from said holster step further comprises the steps of:

releasing said second force;

pulling said moveable trigger housing mechanism back to said first position thereby assisting the removal of said self-loading pistol from said holster.

5. The method of claim 2, wherein said providing a holster step further comprises the steps of:

disposing a first slide rail on said base;

disposing a second slide rail on said base;

moveably disposing a slide block between said first slide rail and said second slide rail, wherein said moveable trigger housing mechanism comprises said slide block;

attaching said second end of said spring to said slide block.

6. The method of claim 5, wherein said providing a holster step further comprises the steps of:

providing a riser having a first end and a second end;

attaching said first end of said riser to said slide block, wherein said second end of said riser extends upwardly from said slide block.

7. The method of claim 6, wherein said providing a holster step further comprises the steps of:

providing a cover formed to include an aperture having a first end and a second end;

attaching said cover to said first slide rail and to said second slide rail, such that said riser extends through said aperture.

8. The holster of claim 7, wherein said providing a holster step further comprises the steps of:

providing a slide platform;

attaching said slide platform on said second end of said riser, wherein said moveable trigger housing mechanism comprises said slide platform.

9. The holster of claim 8, wherein said providing a holster step further comprises the steps of:

providing a cover plate;

attaching said cover plate to said slide platform, wherein said moveable trigger housing mechanism comprises said cover plate.

10. The holster of claim 9, wherein said providing a holster step further comprises the steps of:

providing a trigger guard assembly;

attaching said trigger guard assembly to said cover plate, wherein said moveable trigger housing mechanism comprises said trigger guard assembly.

* * * * *